US009725296B2

(12) United States Patent
Taylor

(10) Patent No.: US 9,725,296 B2
(45) **Date of Patent: *Aug. 8, 2017**

(54) LIQUID DISPENSER FOR A COOLER

(71) Applicant: Magic Tap, LLC, Cleveland, OH (US)

(72) Inventor: Curtis Taylor, Chagrin Falls, OH (US)

(73) Assignee: Magic Tap, LLC, Cleveland, OH (US)

( * ) Notice: Subject to any disclaimer, the term of this patent is extended or adjusted under 35 U.S.C. 154(b) by 30 days.

This patent is subject to a terminal disclaimer.

(21) Appl. No.: 14/805,965

(22) Filed: Jul. 22, 2015

(65) Prior Publication Data

US 2015/0344286 A1 Dec. 3, 2015

Related U.S. Application Data

(63) Continuation of application No. 13/653,809, filed on Oct. 17, 2012, now Pat. No. 9,156,671, which is a (Continued)

(51) Int. Cl.
*B65D 88/54* (2006.01)
*B67D 7/64* (2010.01)

(Continued)

(52) U.S. Cl.
CPC ..... *B67D 7/64* (2013.01); *B67D 1/0004* (2013.01); *B67D 1/0801* (2013.01);

(Continued)

(58) Field of Classification Search
CPC . B67D 7/62; B67D 7/64; B67D 7/645; B67D 7/66; B67D 1/0801; B67D 1/0802; B67D 1/0831; B67D 1/0857; B67D 1/10; F25D 2331/80; F25D 2331/806; F25D 2331/803; F25D 2331/802; Y10T 29/49716

(Continued)

(56) References Cited

U.S. PATENT DOCUMENTS 2,545,350 A 3/1951 Fuld
3,224,329 A 12/1965 Cates (Continued)

FOREIGN PATENT DOCUMENTS

DE 202008004666 1/2009
GB 1384436 2/1975

(Continued)

OTHER PUBLICATIONS

European Search Authority, Supplemental European Search Report for related application No, EP 10784067 dated Feb. 27, 2013.

*Primary Examiner* — Lien Ngo
(74) *Attorney, Agent, or Firm* — Fay Sharpe LLP

(57) ABSTRACT

A cooler having a fountain type dispenser that includes a cooler body, a cooler lid and a liquid pump mechanism that is designed to dispense liquid from the cavity of the cooler body. The cooler lid includes at least one pump opening through a body of the cooler lid, the liquid pump mechanism includes a top portion and a bottom portion, an electric pump and a power supply designed to power said electric pump. The electric pump is designed to draw liquid into the bottom portion and to the top portion when the electric pump is activated.

19 Claims, 16 Drawing Sheets

Related U.S. Application Data continuation of application No. 12/792,287, filed on Jun. 2, 2010, now abandoned.

(60) Provisional application No. 61/548,944, filed on Oct. 19, 2011, provisional application No. 61/669,847, filed on Jul. 10, 2012, provisional application No. 61/672,957, filed on Jul. 18, 2012, provisional application No. 61/183,719, filed on Jun. 3, 2009.

(51) Int. Cl.

| | |
|---|---|
| ***F04D 13/08*** | (2006.01) |
| ***B67D 1/08*** | (2006.01) |
| ***B67D 1/00*** | (2006.01) |
| ***B67D 1/10*** | (2006.01) |
| ***F04D 13/06*** | (2006.01) |

(52) U.S. Cl.

CPC ..... *B67D 1/0857* (2013.01); *B67D 1/10* (2013.01); *F04D 13/068* (2013.01); *F04D 13/086* (2013.01); *Y10T 29/49718* (2015.01)

(58) Field of Classification Search

USPC ..... 222/333, 63, 153.13, 504–508.401, 209, 222/400.7, 400.8, 146.6; 220/211, 220/592.01, 592.16–592.18; 62/398, 62/357.4

See application file for complete search history.

(56) References Cited

U.S. PATENT DOCUMENTS

| | | | | |
|---|---|---|---|---|
| 4,238,054 | A | 12/1980 | Chen | |
| 4,274,562 | A | 6/1981 | Medeiros et al. | |
| 4,429,813 | A | 2/1984 | DeFreitas | |
| 4,440,328 | A | 4/1984 | DeFreitas | |
| 4,444,358 | A | 4/1984 | Spohn et al. | |
| 4,464,983 | A | 8/1984 | Chappell et al. | |
| 4,506,812 | A | 3/1985 | DeFreitas | |
| 4,646,798 | A | 3/1987 | Yoo | |
| 5,104,012 | A | 4/1992 | McAllister et al. | |
| 5,240,151 | A | 8/1993 | Worm | |
| 5,305,927 | A | 4/1994 | Caveza | |
| 5,855,120 | A | 1/1999 | Kim | |
| 5,921,441 | A | 7/1999 | Small et al. | |
| 5,921,445 | A | 7/1999 | Schmitz et al. | |
| 6,056,154 | A | 5/2000 | Fowler | |
| 6,056,166 | A | 5/2000 | Schmitz et al. | |
| 6,070,755 | A | 6/2000 | Evans et al. | |
| 6,390,315 | B1 | 5/2002 | Giddings et al. | |
| 6,793,099 | B1 | 9/2004 | Sleiman | |
| 6,824,013 | B2 | 11/2004 | Harrison et al. | |
| 8,177,098 | B2 | 5/2012 | Penny | |
| 9,156,671 | B2 * | 10/2015 | Taylor | B67D 1/0801 |
| 2001/0030201 | A1 | 10/2001 | Gerhardt | |
| 2005/0155659 | A1 | 7/2005 | Rahimzadeh et al. | |
| 2006/0255052 | A1 | 11/2006 | Svitak | |
| 2006/0273094 | A1 | 12/2006 | Cohen | |
| 2007/0145060 | A1 | 6/2007 | Connors et al. | |
| 2008/0066820 | A1 | 3/2008 | Williams et al. | |
| 2008/0136164 | A1 | 6/2008 | Knappmiller | |
| 2009/0050712 | A1 | 2/2009 | Vitantonio | |
| 2009/0056363 | A1 | 3/2009 | Lee | |
| 2010/0147701 | A1 | 6/2010 | Field | |
| 2010/0308083 | A1 * | 12/2010 | Taylor | B67D 1/0004 222/333 |

FOREIGN PATENT DOCUMENTS

| | | |
|---|---|---|
| WO | 9408865 | 4/1994 |
| WO | 9701490 | 1/1997 |
| WO | 0166943 | 9/2001 |

* cited by examiner

LIQUID DISPENSER FOR A COOLER

The present invention is a continuation of U.S. application Ser. No. 13/653,809 filed Oct. 17, 2012, which in turn claims priority on U.S. Provisional Application Ser. Nos. 61/548,944 filed Oct. 19, 2011; 61/669,847 filed Jul. 10, 2012; and 61/672,957 filed Jul. 18, 2012, all of which are incorporated herein by reference.

The present invention is a continuation of U.S. application Ser. No. 13/653,809 filed Oct. 17, 2012, which in turn claims priority on U.S. application Ser. No. 12/792,287 filed Jun. 2, 2010, which in turn claims priority on U.S. Provisional Application Ser. No. 61/183,719 filed Jun. 9, 2009, which are both incorporated herein by reference.

The present invention is directed to a liquid pump mechanism, particularly to a liquid pump mechanism that converts a beverage container into a beverage container having a fountain-type dispenser, and more particularly to a liquid pump mechanism that converts a sports cooler into a cooler having a fountain-type dispenser. As can be appreciated, the liquid pump mechanism can be used on or with other types of containers to dispense other types of liquids.

BACKGROUND OF THE INVENTION

Sports coolers are commonly used at parties, large gatherings, parties, sporting events and the like to contain and dispense beverages at a particular. These coolers are generally about 1-50 gallon coolers. The standard cooler includes a dispensing valve near the base of the cooler. Typically the valve is opened by pressing a button or lifting a lever. As the liquid level drops in the cooler, the liquid flow out of the valve decreases. Also, since the valve is generally positioned above the bottom of the cooler, liquid remains in the cooler unless the cooler is tilted. However, the tilting of the cooler and the simultaneous opening of the dispensing valve can be very difficult due to the weight of the cooler, and weight of the remaining liquid and/or ice in the cooler. In addition, the tilting of the cooler can be dangerous and/or cause a mess if the cooler moves off the surface upon which the cooler was sitting while the cooler is being tilted. Also, the standard bottom dispenser on the cooler sticks out from the bottom side of the cooler, thus is susceptible to damage when the cooler is transported and/or stored.

In view of the current state of the art of cooler, there is a need for a dispenser that can be used on a wide variety of cooler to conveniently dispense the liquid in such a cooler without having the user tilt the cooler during the dispensement of liquid from the cooler.

SUMMARY OF THE INVENTION

The present invention is directed to a liquid pump mechanism that can be used with a cooler. The liquid pump mechanism designed to dispense beverages from a cooler. As can be appreciated, the liquid pump mechanism can be used to pump liquids other than beverages.

In one non-limiting aspect of the present invention, the liquid pump mechanism of the present invention can be directed to a pump system that can be easily and conveniently used by consumers to dispense beverages from small and large coolers (e.g., half gallon cooler; two liter cooler; gallon cooler; two gallon cooler; five gallon cooler; ten gallon cooler, 20 gallon cooler, 30 gallon cooler, 50 gallon cooler, 100 gallon cooler, etc.). For purposes of this invention, a cooler is defined as an insulated cooler that can hold at least a half gallon of liquid. The liquid pump mechanism of the present invention is particularly useful in dispensing liquids from gallon coolers and larger coolers. The liquid pump mechanism as described in the present invention enables a user to create a fountain type dispenser from a cooler so as to enable convenient dispensing of liquid from the cooler without having to lift or tilt the cooler during the dispensement of liquid from the cooler.

In another and/or alternative non-limiting aspect of the present invention, there is provided a liquid pump mechanism that includes a top portion and a bottom portion. The liquid pump mechanism generally also includes an elongated body; however, this is not required. The material and/or colors of the components of the liquid pump mechanism are non-limiting. Generally, the materials are durable, water resistant, and light weight. Non-limiting materials that can be used include plastic, rubber, metal, resinous material, composite material, etc. The size and shape of the top portion, the elongated body and the bottom portion are non-limiting. For example, the body of the top portion can include a circular, oval and/or polygonal cross-sectional shape of the longitudinal length of the top portion; the elongated body can include a circular and/or oval cross-sectional shape along the longitudinal length of the elongated body; and the bottom portion can include a circular, oval and/or polygonal cross-sectional shape of the longitudinal length of the bottom portion; however, this is not required.

In still another and/or alternative non-limiting aspect of the present invention, the profile of the top portion is generally selected to be a low profile; however, this is not required. The low profile of the top portion, when used, enables the liquid pump mechanism to connect to the top of a cooler in a low profile mode. Generally, the maximum thickness of the top portion of the liquid pump mechanism is less than five inches; however, this is not required. In one non-limiting design, the maximum thickness of the top portion of the liquid pump mechanism is less than four inches. In another non-limiting design, the maximum thickness of the top portion of the liquid pump mechanism is less than three inches. In still another non-limiting design, the maximum thickness of the top portion of the liquid pump mechanism is about 0.5-4 inches. In yet another non-limiting design, the maximum thickness of the top portion of the liquid pump mechanism is about 0.5-3 inches. In still yet another non-limiting design, the maximum thickness of the top portion of the liquid pump mechanism is about 1-3 inches.

In yet another and/or alternative non-limiting aspect of the present invention, the top portion of the liquid pump mechanism includes one or more dispenser activators such as, but not limited to, dispensing tabs, knobs and/or buttons. In one non-limiting embodiment of the invention, one or more dispenser activators can be positioned at least partially on one or more sides of the body of the top portion. The one or more dispenser activators can be used to activate the liquid pump mechanism and cause liquid in a cooler to be dispensed from the liquid pump mechanism. The one or more dispenser activators can be pivotable, rotatable, depressible, contact activated, etc.; however, it can be appreciated that the activation by the one or more dispenser activators can be accomplished by other or additional means (e.g., IR sensor, RF sensor, voice activation, remote control, etc.). In one non-limiting design, at least one dispenser activator is positioned fully on or partially on the at least one side of the body of the top portion; however, this is not required. The at least one dispenser activator is designed to activate the liquid pump mechanism when 1) a cup, glass etc. is pushed up against or otherwise contacts the at least one dispenser activator, and/or a user uses his/her finger to push up against or otherwise contact the at least one dispenser activator. A button, when used, can be depressible; however, this is not required. A dispensing tab, when used, can be depressible and/or pivotable; however, this is not required. A knob, when used, can be rotatable and/or depressible; however, this is not required. One or more of the dispenser activators can include a biasing arrangement (e.g., spring, flexible material, etc.) to bias the position of the at least one dispenser activator in the non-activation position; however, this is not required. When a biasing arrangement is used, the biasing arrangement can be designed to cause the dispenser activator to move or switch from an activation position to a non-activation position; however, this is not required. The activation position causes the liquid pump mechanism to energize one or more components in the liquid pump mechanism to enable the liquid pump mechanism to pump liquid at least partially through the liquid pump mechanism. In another and/or alternative non-limiting design, at least one dispenser activator is positioned fully on or partially on the top and/or side of the body of the top portion; however, this is not required. As can be appreciated, one or more dispenser activators can be positioned only on the side of the body, only on the top of the body, only on the bottom of the body, or any combinations thereof. As can also be appreciated, the body of the top portion can include two or more dispenser activators (e.g., button, etc.). In one non-limiting arrangement, one dispenser activator can be used to activate the liquid pump mechanism, and another dispenser activator can be used to deactivate the liquid pump mechanism; however, this is not required. The size and shape of the one or more dispenser activators are non-limiting. As can also be appreciated, a light sensor and/or motion sensor can also or alternatively be used to activate and/or deactivate the liquid pump mechanism; however, this is not required.

In still yet another and/or alternative non-limiting aspect of the present invention, the top portion of the liquid pump mechanism can optionally include one or more visual indicators used to inform a user 1) when the liquid pump mechanism is activated and/or deactivated, 2) battery power level, 3) pump malfunction, and/or 4) liquid level in cooler. The visual indicator, when used, can be printed material (e.g., on, off, etc.) a light (e.g., green light indicates on, red light indicates off, LED display, LCD display, etc.), and/or a tactile indicator (e.g., raised ribs, etc.). The one or more visual indicators can be located on any portion of the body of the top portion.

In another and/or alternative non-limiting aspect of the present invention, the top portion of the liquid pump mechanism includes one or more dispenser heads that are used to dispense liquid from the liquid pump mechanism. The size and shape of the one or more dispenser heads is non-limiting. The one or more dispenser heads can be connected to the top, bottom and/or sides of the body of the top portion. The one or more dispenser heads can be fixed in a single position relative to the body of the top portion or be movable relative to the body of the top portion. In one non-limiting embodiment, the one or more dispenser heads are connected to the body of the top portion such that the one or more dispenser heads are not movable relative to the body. In another non-limiting embodiment, the one or more dispenser heads are connected to the body of the top portion such that the one or more dispenser heads are movable relative to the body. In such an arrangement, the one or more dispenser heads can be rotatably and/or pivotally connected to the body of the top portion. The movement of the one or more dispenser heads can be used to 1) position the one or more dispenser heads in a desired position relative to the body of the top portion so as to dispense liquid from the liquid pump mechanism, 2) deactivate/activate the liquid pump mechanism, and/or 3) allow/prevent flow of liquid through the one or more dispenser heads. When the one or more dispenser heads are movable, one or more visual (e.g., light, electronic display, writing, arrow, marking, etc.), tactile (e.g., ribs, raised/depressed portion of body, etc.), and/or audible indicators can be used to inform a user about a desired or selectable position for the one or more dispenser heads; however, this is not required. A locking arrangement can be optionally used in association with the one or more movable dispenser heads to allow/prevent movement of the one or more dispenser heads relative to the body of the top portion; however, this is not required. The one or more dispenser heads can be optionally angled upwardly and/or include an internal passageway that angles upwardly; however, this is not required. The upward angle, when used, is designed to cause liquid contained in the one or more dispenser heads to flow back toward the top portion and/or elongated body when the one or more electric pumps are deactivated, thereby limiting or preventing liquid from dripping from the one or more dispenser heads after the one or more electric pumps are deactivate; however, this is not required. In one non-limiting design, the one or more dispenser heads are angled upwardly and/or an internal passageway in the one or more dispenser heads angles upwardly at an angle of about 0.5°-10° when a cooler is placed on a flat surface. In another non-limiting design, the one or more dispenser heads are angled upwardly and/or an internal passageway in the one or more dispenser heads angles upwardly at an angle of about 1°-5° when the cooler is placed on a flat surface. In still another non-limiting design, the one or more dispenser heads are angled upwardly and/or an internal passageway in the one or more dispenser heads angles upwardly at an angle of about 2°-3° when the cooler is placed on a flat surface.

In still another and/or alternative non-limiting aspect of the present invention, the top portion of the liquid pump mechanism can include one or more power sources. As can be appreciated, one or more power sources can be also or alternatively located in the elongated body and/or bottom portion of the liquid pump mechanism, or can be located external to the liquid pump mechanism. The one or more power sources generally include one or more batteries and/or solar cells; however, it can be appreciated that other or additional power sources can be used (e.g., electric plug, hand crank generator, etc.). In one non-limiting design, one or more batteries are fully or partially positioned in the body of the top portion. In such a design, the top potion can optionally include a movable and/or removable battery cover on the body to enable a user to access the battery cavity in the body of the top portion so that the user can insert/remove one or more batteries from the battery cavity. The movable and/or removable battery cover, when used, can be positioned on the top, bottom and/or sides of the body of the top portion. As can also be appreciated, the orientation of the one or more batteries in the battery cavity is non-limiting. As can also be appreciated, the type of batteries is non-limiting (e.g., A, AA, AAA, C, D, 9V, lantern battery, watch battery, calculator battery, etc.). One or more surfaces of the battery cover can optionally include one or more ribs or other type of gripping structures to facilitate in the moving of the battery cover on the body so that a user can access the battery cavity; however, this is not required. A locking arrangement, screws, etc. can optionally be used in association with the battery cover to lock/unlock or secure/unsecure the battery cover to the body of the top portion; however, this is not required.

In yet another and/or alternative non-limiting aspect of the present invention, the liquid pump mechanism includes a bottom portion that is designed to be inserted through an opening in a lid of a cooler and be partially or fully submerged in a liquid in the cooler. The bottom portion shape, size and materials are non-limiting. Generally the bottom portion is formed of a lightweight, durable water resistant material (e.g., plastic, rubber, composite material, metal, etc.). The bottom portion is designed to be positioned at the bottom of the cooler or close to the bottom of the cooler when the liquid pump mechanism is connected to the lid of the cooler and the lid of the cooler is connected to the body of the cooler; however, this is not required. In one non-limiting embodiment, the bottom portion has a longitudinal length of at least about 0.25 inches and generally no more than about 10 inches. In one non-limiting design, the bottom portion has a longitudinal length of about 0.5-6 inches. In another non-limiting design, the bottom portion has a longitudinal length of about 1-4 inches. The longitudinal length of the bottom portion is generally equal to or less that the longitudinal length of the elongated body; however, this is not required. In one non-limiting design, the ratio of the longitudinal length of the bottom portion to the longitudinal length of the elongated body is about 0.01-1:1. In another non-limiting design, the ratio of the longitudinal length of the bottom portion to the longitudinal length of the elongated body is about 0.05-0.5:1. In still another non-limiting design, the ratio of the longitudinal length of the bottom portion to the longitudinal length of the elongated body is about 0.05-0.4:1. The cross-section size and shape of the bottom portion is also non-limiting; however, the size and shape should be selected so that the bottom portion can be inserted into an opening in the lid of the cooler which the liquid pump mechanism is to be used with. In another and/or alternative non-limiting embodiment, the bottom portion has a generally circular cross-sectional shape and has a maximum diameter of about 0.1-3 inches. In another non-limiting design, the bottom portion has a generally circular cross-sectional shape and has a maximum diameter of about 0.25-2 inches. In still another non-limiting design, the bottom portion has a generally circular cross-sectional shape and has a maximum diameter of about 0.5-1.5 inches. The maximum cross-sectional area of the bottom portion can be greater, equal to or less than the maximum cross-sectional area of elongated body. In one non-limiting design, the ratio of the maximum cross-sectional area of the bottom portion to the maximum cross-sectional area of elongated body is about 0.5-3:1. In another non-limiting design, the ratio of the maximum cross-sectional area of the bottom portion to the maximum cross-sectional area of elongated body is about 0.75-2:1. In still another non-limiting design, the ratio of the maximum cross-sectional area of the bottom portion to the maximum cross-sectional area of elongated body, when used, is about 1-1.8:1. In yet another non-limiting design, the ratio of the maximum cross-sectional area of the bottom portion to the maximum cross-sectional area of elongated body is about 1.01-1.75:1. In still another and/or alternative non-limiting one embodiment, the bottom portion has a weight and density that is generally selected so that the bottom portion will sink in water and in most beverages that are consumed by humans; however, this is not required. As such, the average density of the bottom portion is generally greater than the average density of water at 25° C. (997.0479 kg/m$^3$) such that the bottom portion will naturally sink in the water. In yet another and/or alternative non-limiting one embodiment, the bottom portion has one or more openings designed to enable liquid in a container to be drawn to the interior of the bottom portion. The location, shape and size of the one or more openings on the bottom portion are non-limiting. In one non-limiting design, the bottom portion includes at least one opening at the bottom end of the bottom portion. One of the openings can be centrally located in the bottom end; however, this is not required. The one or more openings can be circular; however, it can be appreciated that the one or more openings can have cross-sectional shapes other than a circular shape. As can also be appreciated, the one or more openings can be positioned on other or additional locations on the bottom portion (e.g., one or more openings can be positioned on the side of the bottom portion, etc.).

In still yet another and/or alternative non-limiting aspect of the present invention, the liquid pump mechanism includes optionally one or more electric pumps. The one or more electric pumps are designed to 1) draw liquid into the bottom portion, 2) cause liquid to travel up through the elongated body, when used, and 3) cause liquid to flow to the top portion and out of one or more dispenser heads on the top portion. In one non-limiting embodiment of the invention, the one or more electric pumps can be partially or fully located in the top portion, the elongated body and/or the bottom portion. In one non-limiting design, the one or more electric pumps are partially or fully positioned in the elongated body and/or bottom portion. In another and/or alternative non-limiting design, the one or more electric pumps are fully positioned in the bottom portion. In still another and/or alternative non-limiting design, the liquid pump mechanism includes a single electric pump that is partially or fully positioned in the elongated body and/or bottom portion. In yet another and/or alternative non-limiting design, the liquid pump mechanism includes a single electric pump that is fully positioned in the bottom portion of the liquid pump mechanism. The positioning of the electric pump fully or partially in the bottom portion of the liquid pump mechanism can result in the sound generated by the operation of the electric pump to be significantly muffled, especially when the bottom portion is partially or fully immersed in liquid in a container; however, this is not required. The one or more electric pumps generally include one or more blades that are rotated by the electric pump so as to cause liquid to flow through the liquid pump mechanism. As can be appreciated, the electric pumps can be used to also or alternatively power one or more pistons that cause liquid to flow through the liquid pump mechanism. In another and/or alternative non-limiting embodiment of the invention, the electric motor of one or more of the electric pumps is generally sealed from the liquid that enters the liquid pump mechanism; however, this is not required. The sealing of the electric motor of the one or more electric pumps has one or more advantages, namely 1) the electric motor is not damaged by the liquid, 2) the liquid is not contaminated by the electric motor, and/or 3) the portion of the liquid pump mechanism that includes the one or more electric pumps can be partially or fully submerged in liquid. In one non-limiting design, one or more sealing rings are used to isolate the electric motor of the one or more electric pumps from liquid flowing through the liquid pump mechanism; however, other or additional types of sealing arrangements can be used. In another and/or alternative non-limiting design, the top portion, the elongated body and/or the bottom portion are designed to fully or partially contain the one or more electric pumps and to fully or partially isolate the electric motor of the one or more electric pumps from liquid flowing through the liquid pump mechanism. For example, the bottom portion of the liquid pump mechanism can include a chamber that houses a single electric pump and includes an opening for the shaft of the electric pump to extend therethrough, which opening includes a sealing ring to create a liquid seal between the electric motor of the electric pump shaft and the opening in the chamber; however, this is not required. Such a chamber, when used, can be centrally located on the bottom portion; however, this is not required.

In another and/or alternative non-limiting aspect of the present invention, the liquid pump mechanism includes an elongated body connected between the top portion and the bottom portion of the liquid pump mechanism; however, this is not required. The elongated body, when used, includes one or more channels along the longitudinal length of the elongated body so that liquid can flow from the bottom portion, through the elongated body and to the top portion of the liquid pump mechanism. Generally the elongated body is a single piece component; however, this is not required. The elongated body can be a separate component or be integrally formed with the top portion and/or the bottom portion. The length, shape, cross-section shape, color and/or materials of the elongated body are non-limiting. The elongated body can be partially or fully formed of a flexible material (e.g., plastic, rubber, composite material, metal, etc.); however, this is not required. In one non-limiting embodiment, the elongated body is a separate component from the top portion and/or the bottom portion of the liquid pump mechanism. The elongated body can be designed to be permanently or detachably connected to the top portion and/or the bottom portion of the liquid pump mechanism. When the elongated body is connected to the bottom portion, the elongated body is fluidly connected to one or more openings in the bottom portion. Generally, the bottom portion includes one or more openings in the top of the bottom portion that allows liquid to flow out of the bottom portion after the liquid has been drawn into the bottom portion; however, it can be appreciated that one or more openings can be positioned on other or additional regions of the bottom portion. In one non-limiting design, the bottom portion includes a single top opening and a bottom portion of the elongated body is designed to be connected to the top opening (e.g., positioned into the opening in the bottom portion, fitted about the opening in the bottom portion, etc.). In another and/or alternative one non-limiting embodiment, the elongated body has a generally cylindrical shape; however, the elongated body can have other or additional shapes. The cross-section shape and size of the elongated body can be generally uniform along the longitudinal length of the elongated body; however, it can be appreciated that the cross-section shape and/or size of the elongated body can vary along the longitudinal length of the elongated body. The length of the elongated body is non-limiting. In one non-limiting design, the elongated body has a length of about 1-50 inches. In another non-limiting design, the elongated body has a length of about 2-40 inches. In still another non-limiting design, the elongated body has a length of about 6-30 inches. The cross-section size of the elongated body is also non-limiting. In one non-limiting design, when the elongated body has a circular cross-section shape, the diameter is about 0.1-3 inches. In another non-limiting design, when the elongated body has a circular cross-section shape, the diameter is about 0.25-2 inches. In still another non-limiting design, when the elongated body has a circular cross-section shape, the diameter is about 0.5-1.25 inches. In still another and/or alternative one non-limiting embodiment, one or more portions of the elongated body can be designed to be flexible and/or be formed of a flexible material; however, this is not required. When the elongated body is designed to be partially or fully flexible, such a design allows the elongated body to be more conveniently positioned in different shaped and/or sized cooler. In one non-limiting design, the elongated body is formed of a flexible tubular material. The tubular material can be clear, partially clear, or colored to prevent viewing of the interior of the elongated body.

In still yet another and/or alternative one non-limiting embodiment, the elongated body can be a multi-piece component that is telescoping; however, this is not required. The telescoping elongated body can include two telescoping sections; however, it can be appreciated that the telescoping elongated body can be formed of three or more telescoping sections (e.g., 3, 4, 5, 6, etc.). The telescoping elongated body can be designed to adjust the length of the elongated body based on the depth of the interior portion of the cooler to which the liquid pump mechanism is connected. Generally the telescoping sections are formed of a rigid material so that the telescoping sections can move relative to one another; however, this is not required. In another and/or alternative one non-limiting embodiment, one or more electric wires can partially or fully extend through the elongated body; however, this is not required. For example, when one or more electric pumps are located in the elongated body and/or the bottom portion, and the power supply is located in the top portion, elongated body and/or the bottom portion, one or more electric wires may be required to be positioned within the elongated body and/or along the outside of the elongated body. In one non-limiting design, when the power supply for the one or more electric pumps is separated from the one or more electric pumps that are partially or fully positioned in the elongated body and/or bottom portion the liquid pump mechanism, one or more electric wires are positioned in one or more portions of the interior of the elongated body so as to electrically connect one or more electric pumps to the power supply. When one or more electric wires are positioned in one or more portions of the interior of the elongated body, the one or more electric wires can be isolated from liquid that flows through one or more passageways in the interior of the elongated position that are used to allow liquid to flow through the elongated body; however, this is not required. The isolation of the one or more electric wires has one or more advantages, namely 1) the one or more electric wires are not damaged by the liquid, and/or 2) the liquid is not contaminated by the one or more electric wires. The isolation of the one or more wires, when used, can be achieved in several ways such as, but not limited to, 1) creating a separate passageway in the interior of the elongated body for the one or more electric wires which separate passageway is not in liquid communication with the one or more passageways for the liquid, 2) encasing the one or more electric wires in a tubing or other type of material, which tubing or material creates a separate passageway that is not in liquid communication with the one or more passageways for the liquid, and/or 3) coating the one or more electric wires with a coating (e.g., plastic coating, etc.) to isolate the current conducting wire from the liquid flowing in the elongated body. When a coating or tubing is used, such coating or tubing is generally water resistant and does not react or contaminate water or other types of beverages for human consumption; however, this is not required. In one non-limiting design, a tube is positioned in the at least one of the fluid passageways in the interior of the elongated body. One or more electric wires are positioned in the tube so as to isolate the one or more electric wires from any liquid that flows in the fluid passageway that includes the tube.

In still another and/or alternative non-limiting aspect of the present invention, the liquid pump mechanism of the present invention is designed to fit into and removably or irremovably connected to the lid of a cooler. In one non-limiting embodiment of the invention, the top portion of the liquid pump mechanism is rotatably connected to the lid of the cooler to enable the top portion be swivel relative to the lid; however, this is not required. The lid can optionally include structures that control the amount of rotation of the top portion of the liquid pump mechanism on the lid. The lid can optionally include structures that can be used to inhibit or prevent dispensement of liquids from the top portion of the liquid pump mechanism when the top portion is rotated to a certain portion on the lid.

One non-limiting object of the present invention is the provision of a liquid pump mechanism that can be used to enable convenient dispensing of liquid from coolers without having to lift and then pour or tip and then pour a liquid from the cooler.

Another and/or alternative non-limiting object of the present invention is the provision of a liquid pump mechanism that can convert a cooler into a fountain-type drink dispenser.

Still another and/or alternative non-limiting object of the present invention is the provision of a liquid pump mechanism that includes a electric pump in the base portion to pump liquid upwardly through an elongated body and to the top portion of the liquid pump mechanism.

These and other objects and advantages will become apparent from the following description taken together with the accompanying drawings.

BRIEF DESCRIPTION OF THE DRAWINGS

Reference may now be made to the drawings, which illustrate several non-limiting embodiments that the invention may take in physical form and in certain parts and arrangements of parts wherein.

DETAILED DESCRIPTION OF NON-LIMITING EMBODIMENTS

Figure 1:
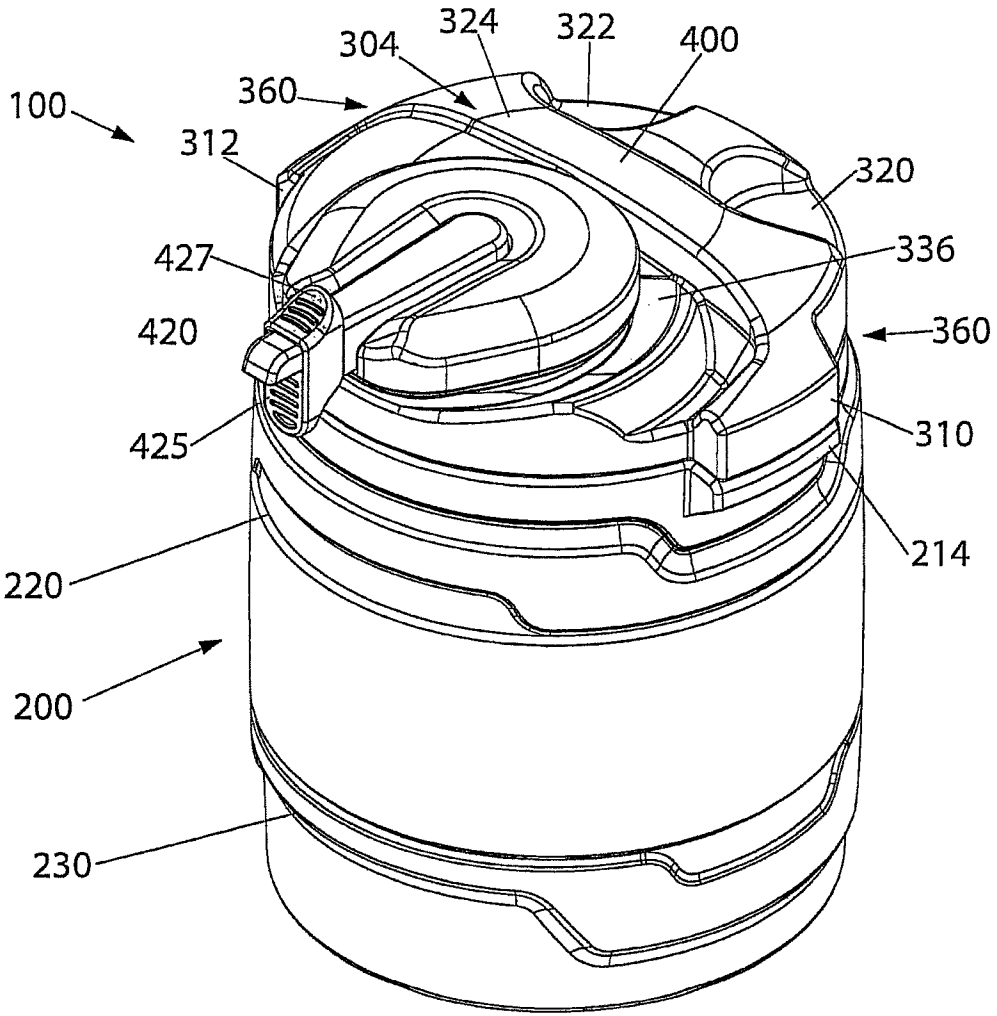
FIG. 1 is a front elevation view of one non-limiting cooler in accordance with the present invention wherein the top portion of the liquid pump mechanism is portioned in an activation position.

Referring now to the drawings wherein the showings are for the purpose of illustrating non-limiting embodiments of the invention only and not for the purpose of limiting same, FIGS. 1-18 illustrate one non-limiting embodiment of the cooler that includes a liquid pump mechanism in accordance with the present invention. Referring now to FIG. 1-8, there is illustrated a cooler 100 that is form of a cooler body 200, a cooler lid 300 and a liquid pump mechanism 400.

Figure 6:
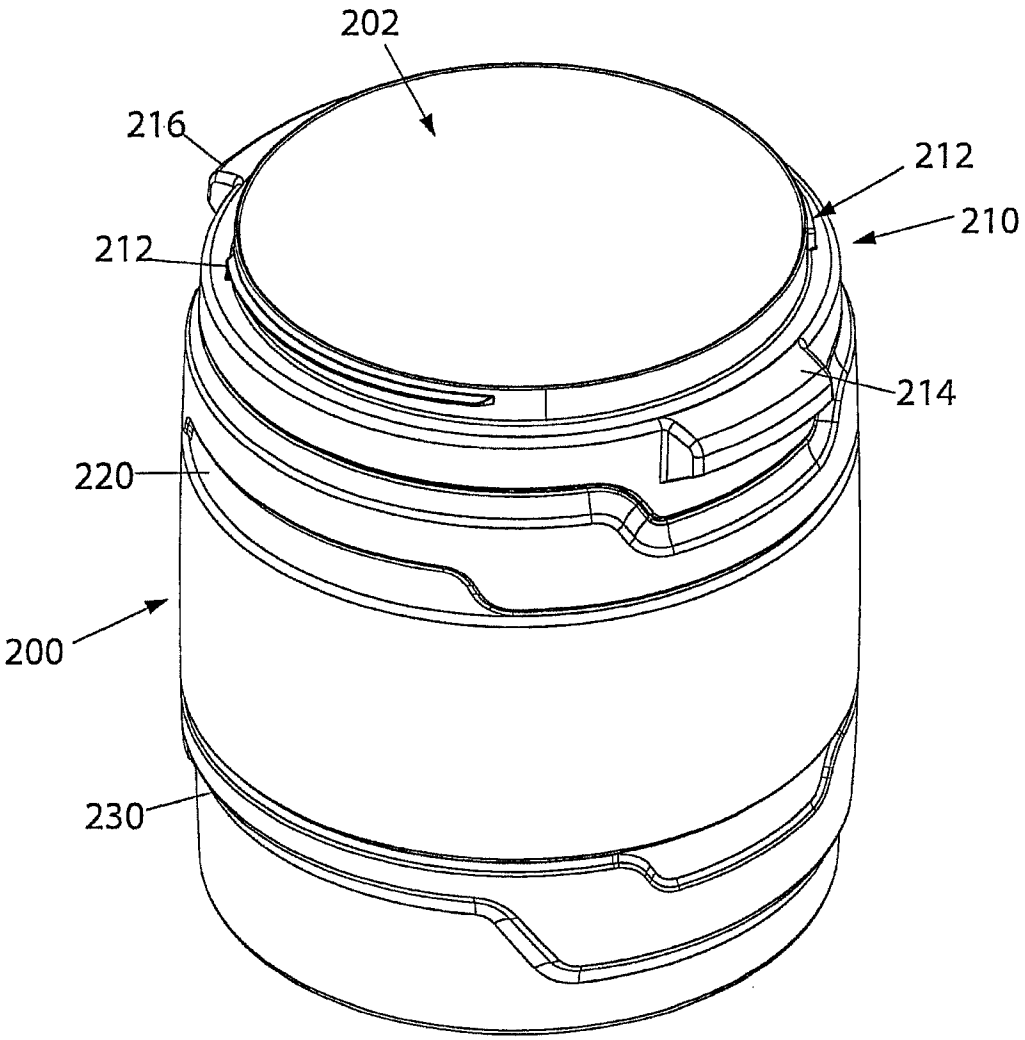
FIG. 6 is a front elevation view of the cooler of FIG. 1 without the lid.

The cooler body is not limited in shape, size, material or color. Generally, the cooler body is formed of a durable material such as a plastic material; however, other or additional materials can be used. The cooler body generally is formed of multiple layers to facilitate in the insulation of a liquid in the interior of the cooler body; however, this is not required. The cooler body includes an internal cavity 202 that is designed to hold a liquid. The capacity of the internal cavity is non-limiting. Generally the internal cavity is designed to hold 1-60 gallons of liquid; however, other sizes can be used. The general shape of the internal cavity is generally cylindrical as illustrated in FIG. 6; however, this is not required. The bottom of the cooler body is generally flat; however, this is not required.

The top portion 210 of the cooler body generally includes a threaded region 212 that is designed to engage a corresponding threaded region on the cooler lid 300 so that the cooler lid can be connected and disconnected from the top portion of the cooler body; however, this is not required. The threaded region can fully or partially encircle the top portion of the cooler body. As illustrated in FIG. 6, the threaded region only partially encircles the top portion of the cooler body. As can be appreciated, the cooler lid can be connected to the top portion of the cooler body in other or additional ways (e.g., snap or friction fit, latch connection, etc.).

The top portion of the cooler body can optionally include one or more handles 214, 216. The number of handles, and the size and shape of the one or more handles are non-limiting. Generally the one or more handles are integrally formed with and non-detachable from the cooler body; however, it can be appreciated that the handles can be designed to be detachable from the body of cooler body.

The cooler body can optionally include one or more outer surface structures that can be used to facilitate in the carrying of the cool body, movement of the cooler body and/or the securing of the cooler body to a fixture. The number, shape and size of the outer surface structures are non-limiting. As illustrated in FIG. 6, the outer surface of the cooler body includes two ridged regions 220, 230. As can be appreciated, the less than two or more than two ridged regions can be formed on the cooler body. One or both of the ridged regions can be used to facilitate in secure the cooler body to a fixture (e.g., truck bed, table top, bench, etc.). For example, bungee cords, rope, etc. can be inserted in or under the ridges to facilitate securing the cooler body in a fixed position during the transport and/or use of the cooler; however, this is not required.

The cooler lid 300 is designed to be removable connected to the cooler body; however, this is not required. The cooler lid is not limited in shape, size, material or color. Generally, the cooler body is formed of a durable material such as a plastic material; however, other or additional materials can be used. The cooler lid can be formed of multiple layers to facilitate in the insulation of a liquid in the interior of the cooler body; however, this is not required. The materials used to form the cooler lid can be the same or different from the materials used to form the cooler body. The bottom of the cooler lid includes one or more threads that are designed to engage with the threaded region 212 on the cooler body to facilitate in the connection and detachment of the cooler lid from the cooler body. As can be appreciated, the cooler lid can include other or additional structures to enable the cooler lid to be connected to the cooler body in other ways.

Figure 2:
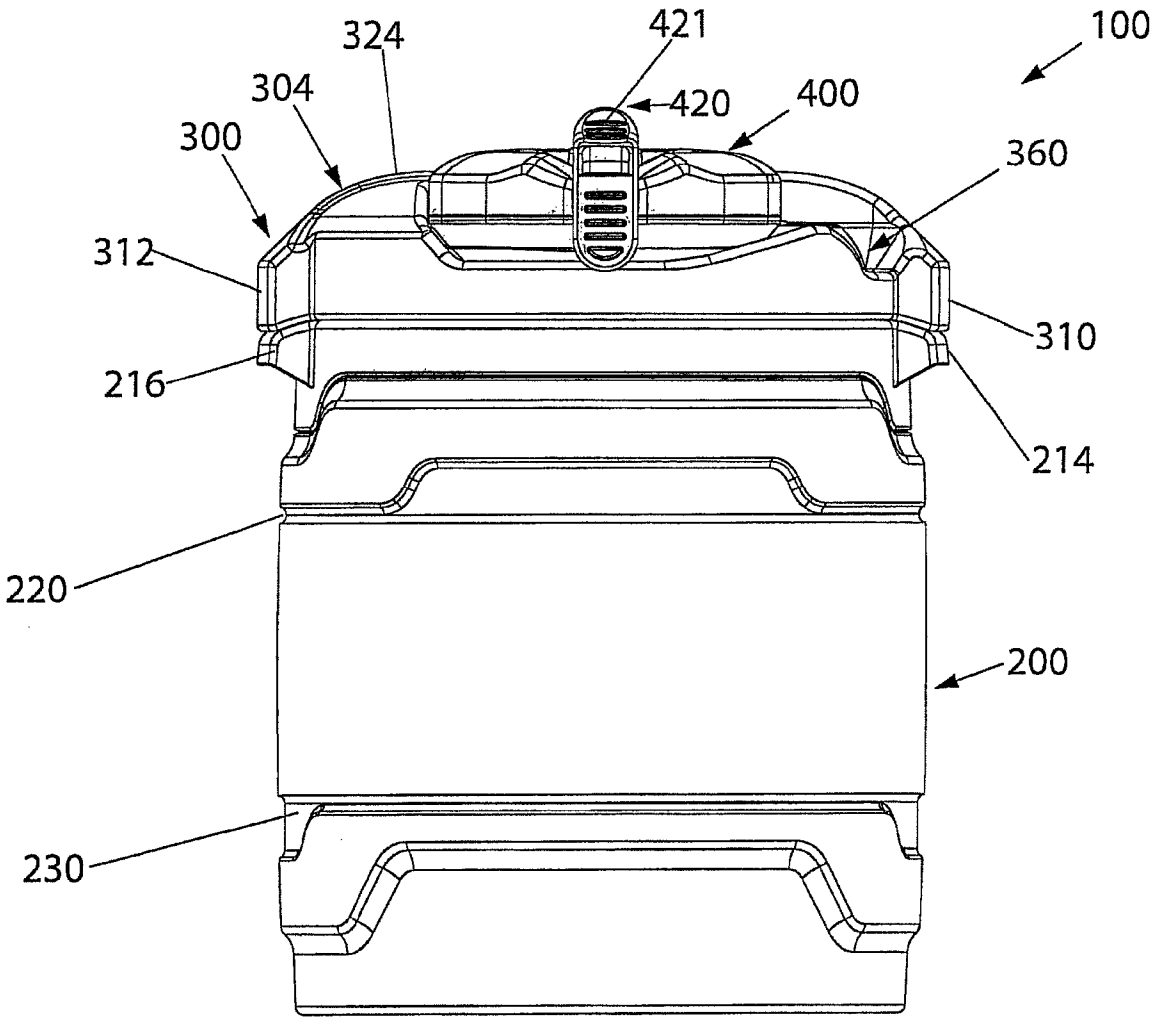
FIG. 2 is a front view of the cooler of FIG. 1.
Figure 4:
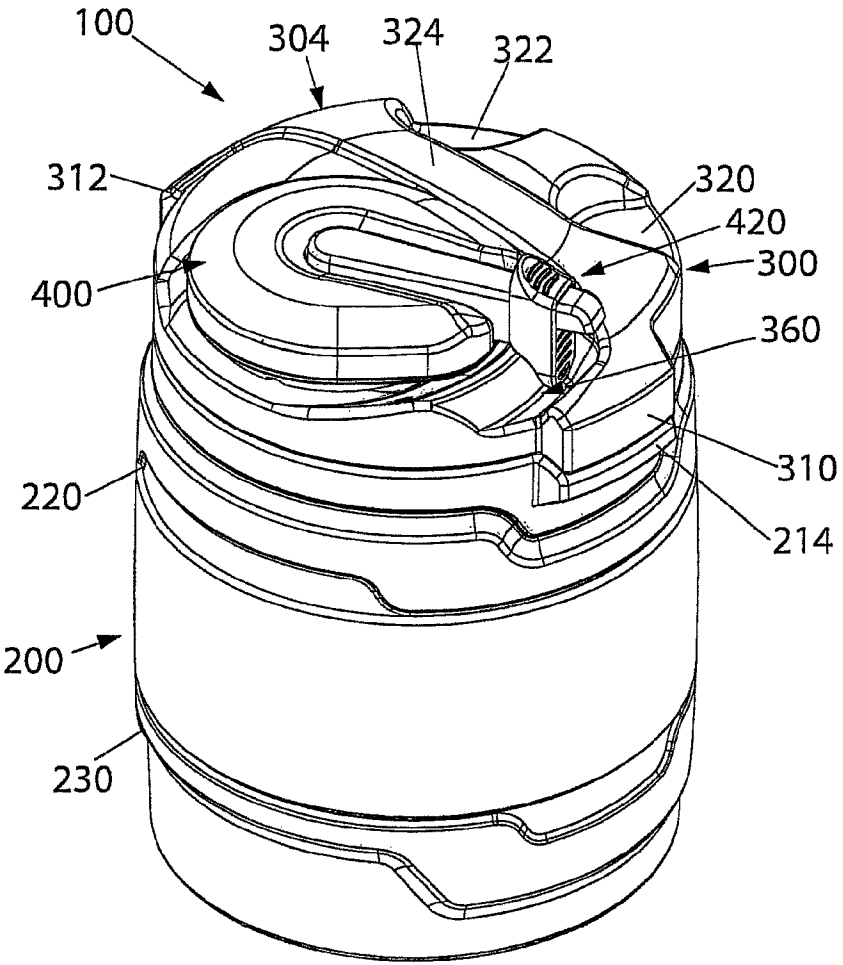
FIG. 4 is a front elevation view of the cooler of FIG. 1 wherein the top portion of the liquid pump mechanism as been rotated to a non-activation position.

The cooler lid is generally shaped such that when connected to the top portion of the cooler body, one or more corresponding structures on the cooler body and cooler lid are aligned; however, this is not required. For example, the cooler lid includes two handle portions 310, 312. The handles are generally positioned on the outer peripheral regions of the cooler lid; however, this is not required. These handle portions can be used to facilitate in the insertion and/or removal of the cooler lid form the cooler body. As illustrated in FIGS. 1, 2, and 4, when the cooler lid is fully inserted onto the cooler body, handle portions 310, 312 are aligned with handles 214, 216 on the cooler body. As is also illustrated in FIGS. 1, 2 and 4, other structures of the cooler lid such as the bottom edge 302 of the lower outer peripheral region 301 of the cooler lid have a similar shape and size such that when the cooler lid is fully inserted onto the cooler body, the bottom edge 302 closely aligns with the adjacently positioned top portion of the cooler body.

Figure 7:
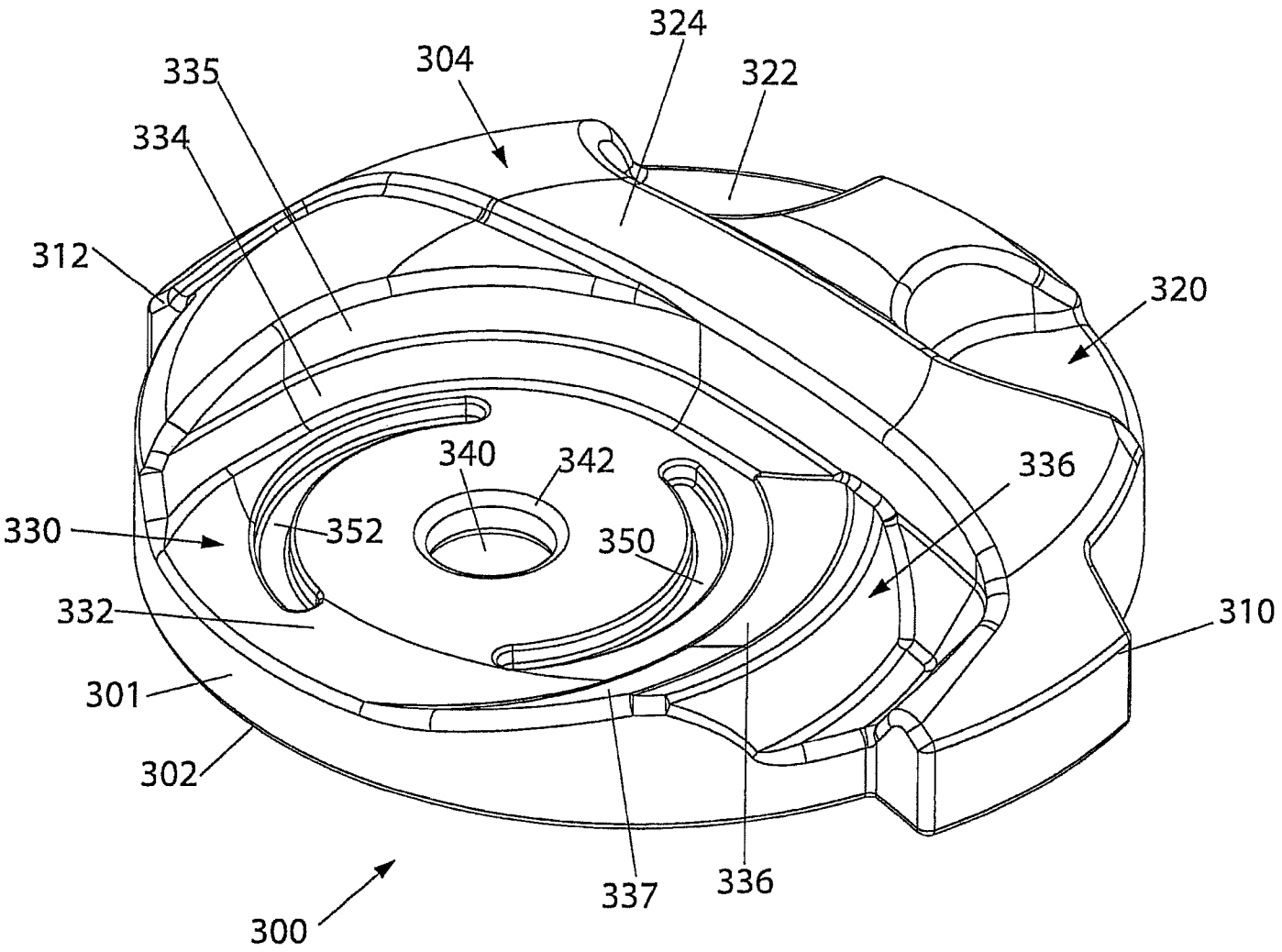
FIG. 7 is a front elevation view of the lid of the cooler without the liquid pump mechanism.
Figure 8:
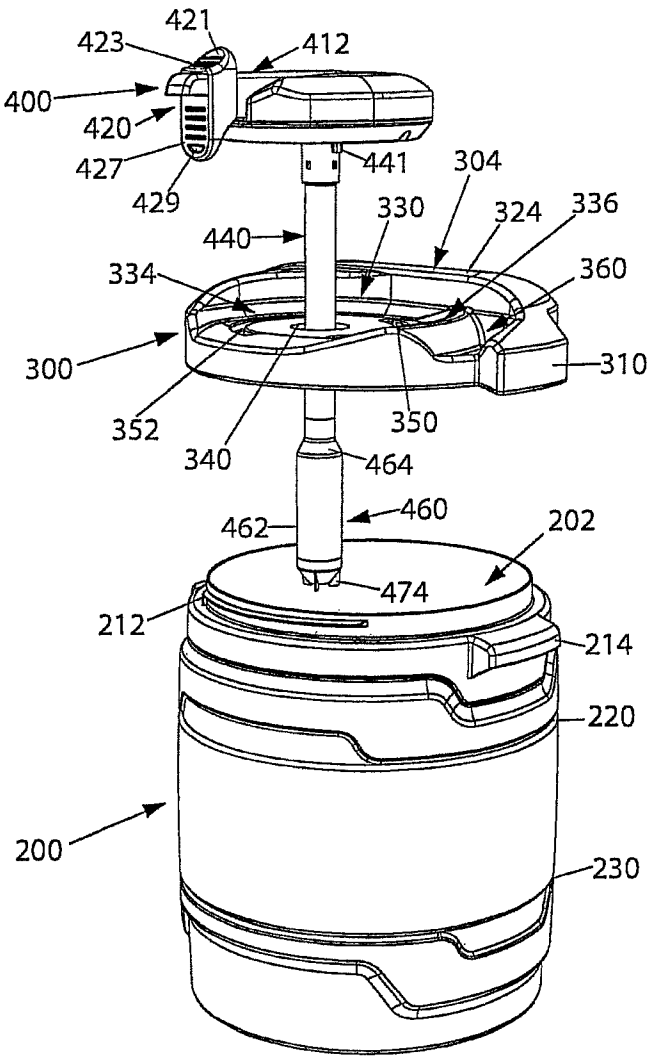
FIG. 8 is an exploded view of the cooler of FIG. 1.

As illustrated in FIG. 7, the top portion 304 includes several structures. The top portion can optionally include one or more cup or container cavities 320, 322 can be used to receive a bottom portion of a cup or container so that one or more cups or container can be placed on the top portion of the cooler lid. The number, size, shape and location of the one or more container cavities on the cooler lid, when used, are non-limiting.

The top portion of the cooler lid can include a recessed pump cavity 330. As illustrated in FIG. 7, a ridge 324 divides the container cavities from the pump cavity. The bottom surface 332 of the recessed pump cavity is positioned below the top surface of ridge 324. The ridge generally represents the highest structure on the cooler lid (e.g., thickest point on the cooler lid or most elevated point on the top portion of the cooler measured from the bottom edge 302); however, this is not required. The depth of the recessed pump cavity is selected so that a majority or all of the top portion of the liquid pump mechanism is positioned even with or below the top surface of the ridge or highest structure on the cooler lid when the top portion of the liquid pump mechanism is fully connected to the cooler lid as illustrated in FIG. 2. Generally at least about 60 percent of the top portion of the liquid pump mechanism is positioned below the top surface of the ridge or highest structure on the cooler lid when the top portion of the liquid pump mechanism is fully connected to the cooler lid. Typically, at least about 75 percent of the top portion of the liquid pump mechanism is positioned below the top surface of the ridge or highest structure on the cooler lid when the top portion of the liquid pump mechanism is fully connected to the cooler lid. As illustrated in FIG. 7, a majority of the perimeter of the recessed pump cavity is generally raised above the bottom surface of the cooler lid as illustrated in FIG. 7. Generally, at least about 60% of the perimeter of the recessed pump cavity is raised above the bottom surface of the cooler lid. Typically, at least about 70% of the perimeter of the recessed pump cavity is raised above the bottom surface of the cooler lid. As illustrated in FIG. 7, the front portion of the recessed pump cavity does not include a raised portion or ridge; however, this is not required. In the other regions of the recessed pump cavity, rims 334, 336 and ridge 324 form the raised perimeter regions of the recessed pump cavity. The shape and height of rims 334, 336 and ridge 324 are non-limiting. The two rims are illustrated as having an arcuate shape and an upper sloped portion 335, 337; however, this is not required. The shape of the rims and the sloped portion of the rims are designed to facilitate in the support and rotational movement of the top portion of the liquid pump mechanism when the liquid pump mechanism is connected to the cooler lid.

The bottom surface of the recessed pump cavity includes a pump opening 340. The pump opening passes fully through the cooler lid as illustrated in FIG. 7. The pump opening can include a tapered top edge 342; however, this is not required. The tapered top edge, when used, can facilitate in the insertion and/or connection of the top portion of the liquid pump mechanism to the cooler lid. The size and shape of the pump opening is non-limiting. Generally the pump opening has a circular cross-sectional shape. Generally the pump opening is positioned at the center of the recessed pump cavity as illustrated in FIG. 7; however, this is not required.

Positioned about the pump opening is one or more rotational slots 350, 352. The one or more slots may or may not fully through the cooler lid. The one or more rotational slots can fully or partially encircle the pump opening. As illustrated in FIG. 7, both of the rotational slots only partially encircle the pump opening, are spaced from one another, have generally the same length and shape and size, and are spaced generally the same distance from the pump opening; however, this is not required. Generally, when the two or more slots are positioned at similar distances from the pump opening, the length of the two or more slots is generally the same; however, this is not required. However, when the two or more slots are positioned at different distances from the pump opening, the length of the two or more slots is generally different; however, this is not required. In one non-limiting arrangement, one or more slots fully encircle the pump opening. In another non-limiting arrangement, one or more slots do not fully encircle the pump opening. In such an arrangement, one or more slots only encircle up to about 90% of the pump opening, typically up to about 75% of the pump opening, more typically up to about 50% of the pump opening, still more typically up to about 49% of the pump opening, yet still more typically up to about 45% of the pump opening, and yet more typically up to about 40% of the pump opening.

The cooler lid can optionally include a dispenser tab cavity 360. The dispenser tab cavity, when used, can be positioned on one or more sides of the recessed pump cavity. As illustrated in FIG. 7, the dispenser tab cavity is located on only one side of the recessed pump cavity. The dispenser tab cavity is designed to receive a dispenser tab that is located on the top portion of the liquid pump mechanism when the top portion of the liquid pump mechanism is rotated on the cooler lid to a non-operation position. The dispenser tab cavity is designed to both receive the dispenser tab and limit or prevent depression of the dispenser tab so as to inhibit or prevent the activation of the liquid pump mechanism and dispensement of liquid from the liquid pump mechanism when the top portion of the liquid pump mechanism is rotated on the cooler lid to a non-operation position. Generally the rotational slots are designed to enable the top portion of the liquid pump mechanism to be rotated on the cooler lid between and operation position and a non-operation position, and to also limit the movement of the top portion of the liquid pump mechanism so that the dispenser tab can enter and exit the dispenser tab cavity and limiting or preventing damage to the dispenser tab when the dispenser tab enters and exits the dispenser tab cavity. When the dispenser tab is positioned in the dispenser tab cavity, the dispenser tab cavity can inhibit or prevent damage to the dispenser tab during the movement of the cooler and/or non-use of the liquid pump mechanism. The size and shape of the dispenser tab cavity is non-limiting.

Figure 9:
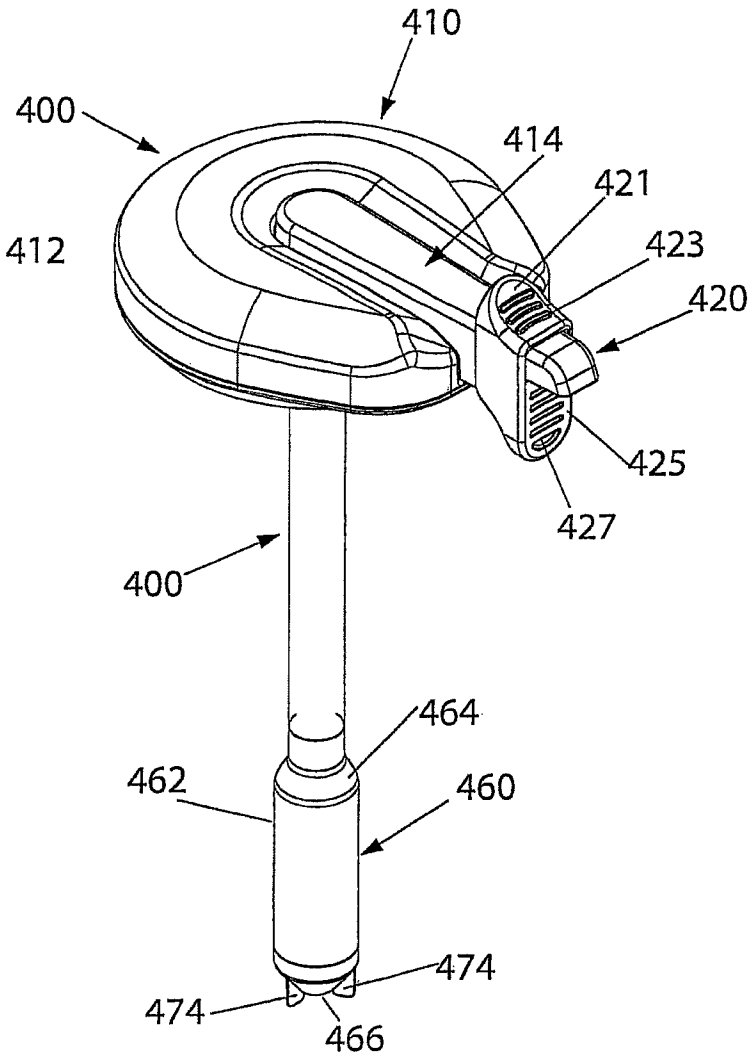
FIG. 9 is a front elevation view of the one non-limiting liquid pump mechanism.
Figure 10:
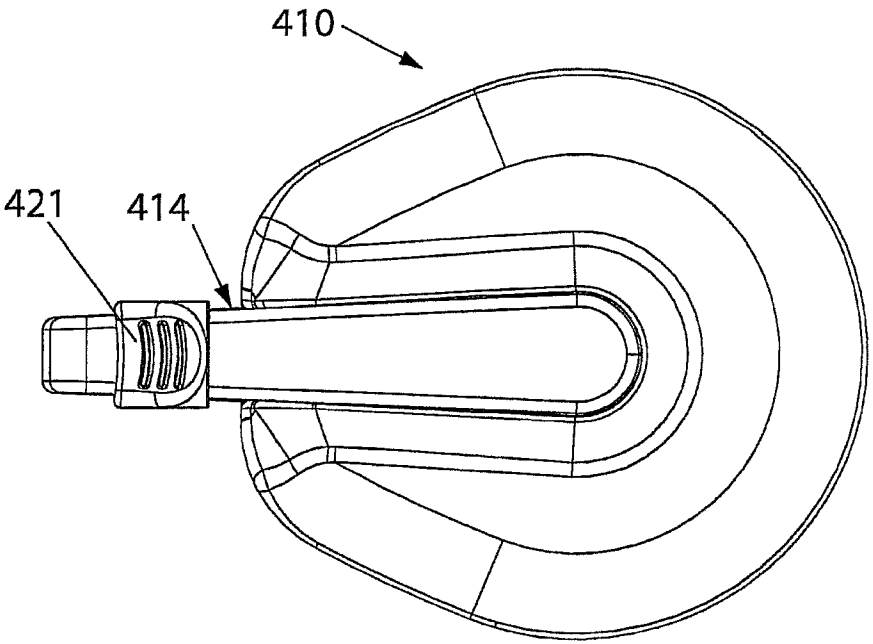
FIG. 10 is a top plan view of the liquid pump mechanism of FIG. 9.

Referring now to FIG. 9, there is illustrated one non-limiting embodiment of a liquid pump mechanism 400 in accordance with the present invention. The liquid pump mechanism is designed to dispense liquid, not shown, from the cooler body 200 of cooler 100 into a glass, cup, container or the like. A variety of liquids can be dispensed by the liquid pump mechanism. Most liquids consumed by humans (e.g., water, fruit juice, vegetable juice, milk, soda, energy drinks, protein drinks, tea, coffee, etc.) can be dispensed by the liquid pump mechanism. The liquid pump mechanism of the present invention enables a user to create a fountain type dispenser from a cooler to enable convenient dispensing of liquid from the cooler without having to lift or tilt the cooler and then dispense liquid from the cooler.

The liquid pump mechanism 400 includes a top portion 410, an elongated body 440 and a bottom portion 460. The materials and/or colors of the components of the liquid pump mechanism are non-limiting.

Figure 15:
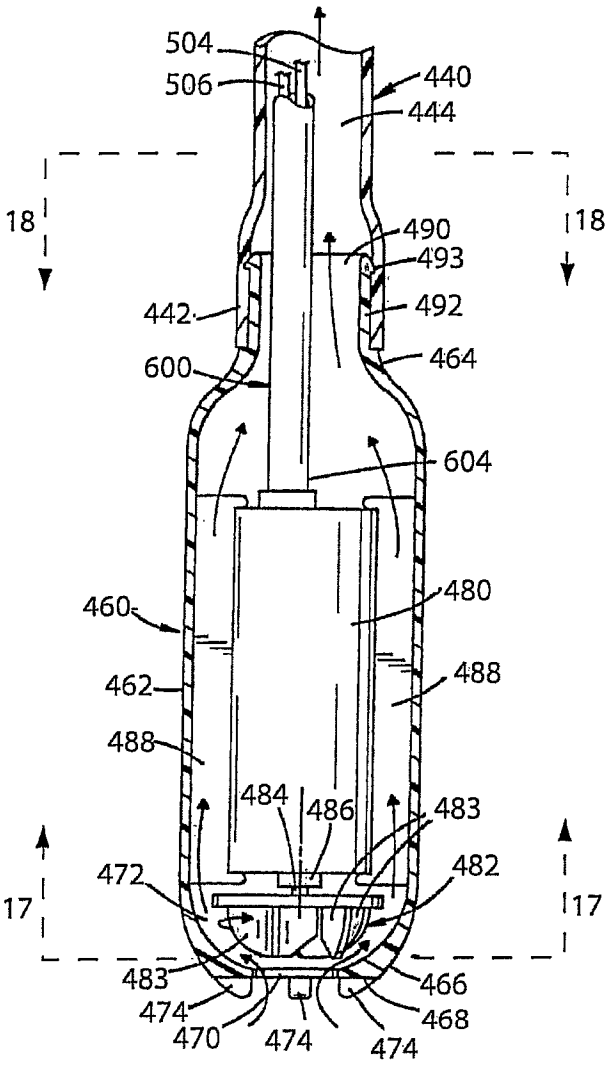
FIG. 15 is a cross-sectional view of the bottom portion and a section of the elongated body of the liquid pump mechanism of FIG. 14.
Figure 16:
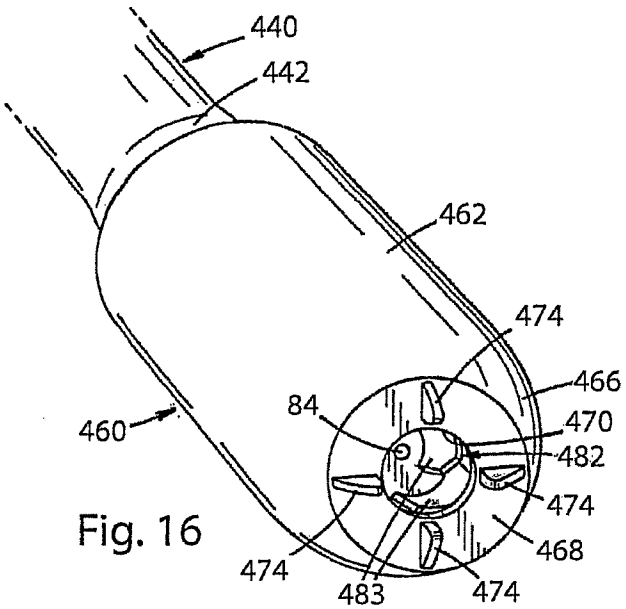
FIG. 16 is an enlarged elevation view of the bottom portion and lower portion of the elongated body of the liquid pump mechanism of FIG. 9.

As illustrated in FIGS. 15 and 16, the bottom portion 460 of the liquid has a generally cylindrical shape body 462 which has upper and lower tapered ends 464, 466; however, it can be appreciated that the bottom portion can have many other shapes. The bottom portion is generally formed of a plastic material; however, other or additional materials can be used to form all or a portion of the bottom portion. The length of the bottom portion is non-limiting. In one non-limiting design, the bottom portion has a length of about 0.5-8 inches, typically about 1-6 inches, and more typically about 1-4 inches. The cross-section size and shape of the bottom portion is also non-limiting. In one non-limiting design, when the bottom portion has a circular cross-section shape, the diameter is about 0.25-3 inches, typically about 0.5-2 inches, and more typically about 0.5-1.5 inches. The cross-sectional size and/or shape of the bottom portion can be constant or vary along the longitudinal length or central axis of the bottom portion.

Figure 14:
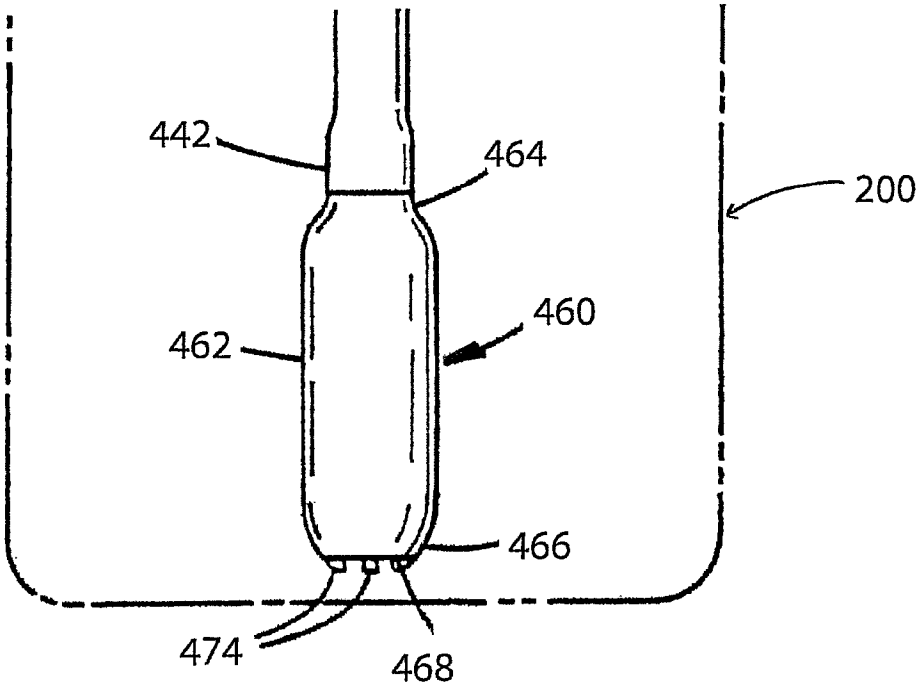
FIG. 14 front view of the bottom portion and a section of the elongated body of the liquid pump mechanism of FIG. 9.

As best illustrated in FIGS. 14-16, the bottom end 468 of the bottom portion 460 includes an opening 470. As can be appreciated, the bottom portion can include more than one opening; however, this is not required. As can also be appreciated, the opening can be located in other or additional locations on the bottom portion; however, this is not required. The opening 470 is designed to enable liquid, not shown, in the body of the cooler to be drawn to the interior 472 of the bottom portion. The bottom portion is illustrated as including a centrally located circular opening in the bottom end; however, it can be appreciated that 1) the opening can have shapes other than a circular shape, 2) the opening does not have to be in the center of the bottom end, 3) the bottom portion can include more than one opening, 4) one or more openings can be positioned on the side of the bottom portion, and/or 5) an opening does not need to be positioned at the bottom end of the bottom portion. One or more base ribs 474 can be optionally connected to or formed on the bottom end of the bottom portion. The base ribs can be used to elevate the bottom end from a bottom surface of a container when the bottom portion is placed into a container. The spacing of the bottom end 168 from the bottom of a container facilitates in preventing the opening 470 from forming a seal with the bottom surface of the container and thereby inhibiting or preventing liquid in the container from being drawn through the opening 470 and into the interior 472 of the bottom portion. As illustrated in FIG. 16, four ribs 474 are positioned on the bottom end 468 of the bottom portion. As can be appreciated, when ribs are used, more than four or less than four ribs can be used. The shape of the ribs, when used, is non-limiting.

Figure 17:
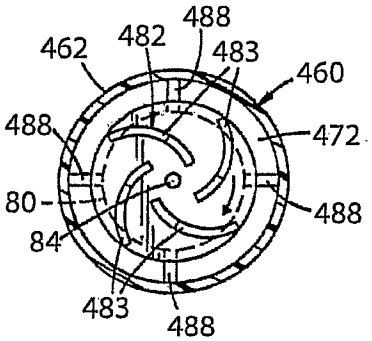
FIG. 17 is a cross-sectional view along line 17-17 of FIG. 15.

Positioned in the interior 472 of the body 462 of the bottom portion 460 is an electric pump 480. The electric pump is designed to rotate a blade 482 which causes liquid in the cooler body to be drawn through opening 470 and into the interior 472 of bottom portion 460 as illustrated by the arrows in FIG. 15. A rotatable shaft 484 is connected between the electric pump and the blade. A sealing ring 486 can be used to form a liquid seal to inhibit or prevent liquid from contacting the electric pump and/or entering the interior of the electric pump. The electric pump in the bottom portion of the liquid pump mechanism is generally partially or fully sealed from the liquid that enters the interior of the bottom portion of the liquid pump mechanism; however, this is not required. The sealing of the electric pump has one or more advantages, namely 1) the electric pump is not damaged by the liquid, and/or 2) the liquid is not contaminated by the electric pump. The blade 482 includes a plurality of fins 483. As illustrated in FIG. 17, the blades can have an arcuate shape to facilitate in drawing liquid into the bottom portion when the electric pump rotates the blade. An electric pump mount chamber or brackets 488 can be used to mount the electric pump in the interior 472 of the bottom portion. As can be appreciated, more than one electric pump can be used to rotate one or more blades. As can also be appreciated, all or a portion of the electric pump can also or alternatively be positioned in the top portion and/or elongated body of the liquid pump mechanism. It has been found that by placing the electric pump fully or partially in the bottom portion of the liquid pump mechanism, the sound generated by the operation of the electric pump is significantly muffled, especially when the bottom portion is partially or fully immersed in liquid in a container. Furthermore, by placing the electric pump in the bottom portion, a smaller profile for the top portion can be obtained.

A top opening 490 is positioned at or near the upper tapered end 464 of the bottom portion. As illustrated in FIG. 15, a connection flange 492 extends upwardly from tapered end 464 and terminates at top opening 490. The lower end 442 of elongated body 440 is illustrated as being fitted about connection flange 492 to form a connection between the elongated body 440 and the bottom portion 160. As illustrated by the arrows in FIG. 15, when the electric pump 480 rotates blade 482, liquid in the cooler body is drawn into the interior 472 of the bottom portion via opening 470, and then flows upwardly through the interior and out of the bottom portion via top opening 490 and into the inner passageway 444 of the elongated body. As can be appreciated, the bottom portion can include more than one top opening. As can also be appreciated, the size and/or shape of the one or more top openings are non-limiting. Furthermore, the location of the one or more top openings on the bottom portion is non-limiting.

Generally, the lower end of the elongated body 440 is irremovably connected to the bottom portion 460; however this is not required. The elongated body is illustrated as having a generally cylindrical shape; however, the elongated body can have other or additional shapes. The cross-section shape and size of the elongated body is illustrated as being generally uniform along most of the longitudinal length of the elongated body; however, it can be appreciated that the cross-section shape and/or size of the elongated body can vary along the longitudinal length of the elongated body. The length of the elongated body is non-limiting. In one non-limiting design, the elongated body has a length of about 2-50 inches, and typically about 5-30 inches. The cross-section size of the elongated body is also non-limiting. In one non-limiting design, when the elongated body has a circular cross-section shape, the diameter is about 0.25-3 inches, and typically about 0.5-2 inches. One or more portions of the elongated body can be designed to be flexible and/or be formed of a flexible material; however, this is not required. When the elongated body is designed to be partially or fully flexible, such a design allows the elongated body to be more conveniently positioned in different shaped and sized containers. In one non-limiting design, the elongated body is formed of a flexible tubular material. The tubular material can be clear, partially clear, or colored or coated to partially or fully prevent viewing of the interior of the elongated body. Generally the elongated body is a single, flexible piece of material; however, this is not required.

As mentioned above, the interior of the elongated body includes one or more passageways 444 to enable liquid to flow from the lower end of the elongated body to the upper end 446 of the elongated body 440. The lower end 442 is illustrated as being stretched about connection flange 492 on the bottom portion. An adhesive can also be used to secure the elongated body to the bottom portion; however, this is not required. The outer surface of the connection flange 492 can include one or more connection ribs 493 to facilitate in maintaining the connection between the elongated body and the bottom portion; however, this is not required. As can be appreciated, other or additional arrangements can be used to form a connection between the bottom portion and the elongated portion. Generally, the connection between the bottom portion and the elongated body forms a liquid proof seal; however, this is not required.

Figure 18:
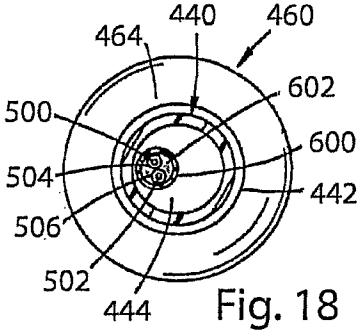
FIG. 18 is a cross-sectional view along line 18-18 of FIG. 15.

The elongated body can include one or more inner passageways. The inner passageway 444 of the elongated body can include one or more electric wires 500, 502; however, this is not required. The electric wires can be coated with an insulating and/or protective material 504, 506; however, this is not required. When the power supply for the electric pump is partially or fully positioned in the top portion 410 and/or elongated body 440, one or more electric wires are typically positioned in one or more portions of the inner passageway of the elongated body so as to electrically connect the electric pump to the power supply. When one or more electric wires are positioned in the inner passageway of the elongated body, the one or more electric wires can be isolated from the liquid in the inner passageways; however, this is not required. The isolation of the one or more electric wires has one or more advantages, namely 1) the one or more electric wires are not damaged by the liquid, and/or 2) the liquid is not contaminated by the one or more electric wires. The isolation of the one or more wires, when used, can be achieved in several ways such as, but not limited to, 1) creating a separate passageway in the interior of the elongated body for the one or more electric wires which separate passageway is not in fluid communication with the one or more passageways for the liquid, 2) encasing the one or more electric wires in a tubing or other type of material, which tubing or material, and/or 3) coating the one or more electric wires with a coating (e.g., plastic coating, etc.). As illustrated in FIG. 18, the electric wires 500, 502 are coated with a protective/insulative coating 504, 506 and are also positioned in the inner cavity of protective tube 600. The lower end 604 of the protective tube 600 is illustrated as being connected to the top of electric pump 480. Generally, a liquid seal is formed between the lower end of the protective tube and the electric pump; however, this is not required. The top end of the protective tube is designed to be connected to the top portion 410 of the electric pump. Generally, a liquid seal is formed between the top end of the protective tube and the top portion; however, this is not required. In such an arrangement, the protective tube extends partially or fully along the length of the elongated body. In the non-limiting arrangement illustrated in FIGS. 15 and 18, the electric wires are positioned in the protective tube so as to isolate the electric wires from any liquid that flows in the inner passageway of the elongated body. The lower end of the protective tube is connected to the electric pump so that liquid flowing from the bottom portion into the elongated body does not enter the tube and/or contact the one or more electric wires. Likewise, the upper end of the protective tube is connected to the top portion of the electric pump so that liquid flowing in the elongated body into the top portion of the liquid pump mechanism does not enter the protective tube and/or contact the electric wires. The protective tube is generally formed of a flexible material; however, this is not required. The electric wires are also generally flexible; however, this is not required.

Figure 13:
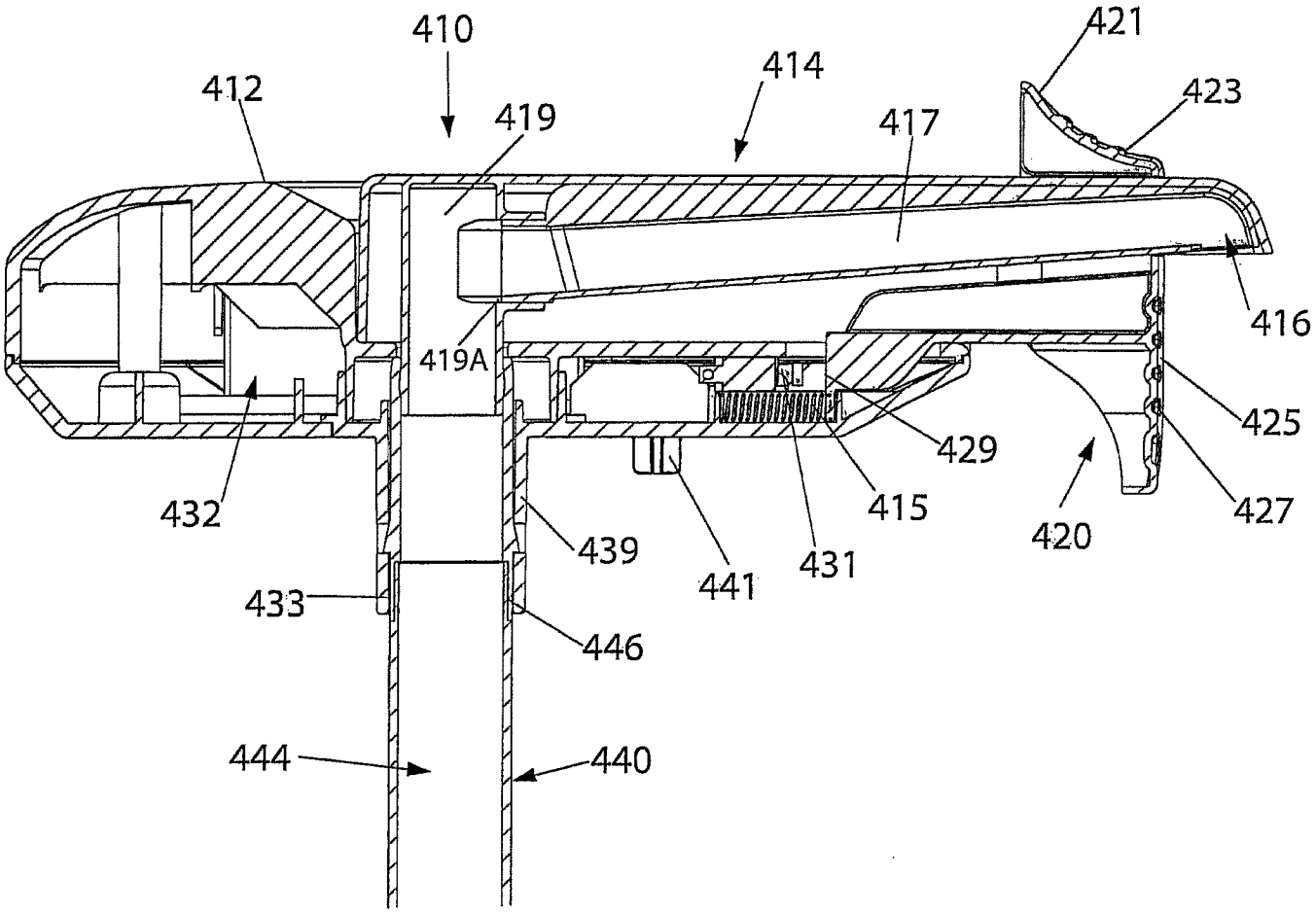
FIG. 13 is a cross-sectional view of the liquid pump mechanism of FIG. 9.

Referring now to FIGS. 8-13, the top portion 410 of the liquid pump mechanism 400 includes a dispenser head 414 and a dispenser tab 420. As indicated by the arrow in FIG. 13, the dispenser tab 420 is designed to be slidably connected to the dispenser head 414. The dispenser tab is designed to slide in a rearward and forward direction as illustrated by the arrow in FIG. 13. The dispenser tab is designed to be depressed by a user or a cup or container to move the dispenser tab rearwardly to an actuation position to cause the actuation of the electric pump, which in turn causes liquid to flow into the bottom portion, through elongated body, into the body of top portion and out of dispenser opening 416 of dispenser head 414. The dispenser tab is generally biased in a forward position or non-activation position by a biasing arrangement, such as a spring 415 or the like; however, this is not required. When the dispenser tab is in the non-activation position, the electric pump is not actuated by the power supply. As can be appreciated, many other arrangements can be used to enable a user to cause liquid to be dispensed from the dispenser opening of dispenser head (e.g., switch, knob, button on top portion, motion sensor, touch sensor, etc.). The depression of the dispenser tab can be accomplished in at least two ways. The first method is by the user placing a glass, cup or other type of container under the dispenser opening of dispenser head and then manually pressing the dispenser tab. The top section 421 includes a curved surface that is designed to be conveniently depressed by the finger of a user. The top section can optionally include ribbed portions 423 or a non-smooth surface to facilitate in the user gripping and pushing the dispenser tab as the dispenser tab is moved rearwardly to the activation position. The second method is by positioning a cup or container below the dispenser opening and then pushing or pressing a portion of the cup or container against the bottom section 425 of the dispenser tab to move the dispenser tab rearwardly to the activation position. The bottom section can optionally include ribbed portions 427 or a non-smooth surface to facilitate in the cup or container gripping the dispenser tab as the dispenser tab is moved rearwardly to the activation position. The size and configuration of the top and bottom sections of the dispenser tab is non-limiting. Generally the two sections have a different shape and the bottom section is larger than the top section as illustrated in FIG. 13; however, this is not required. The front face of the bottom section is generally 70-100° to bottom surface of the dispenser opening, and more particularly about 90° to the bottom surface of the dispenser opening; however, this is not required.

As illustrated in FIG. 13, when the rear face 429 of the dispenser tab is moved a sufficient rearward distance, the rear face contacts an activation switch 431 which causes the electric pump to activate. Once a cup or container is removed from the bottom section of the dispenser tab and/or a user removes his/her finger from the top section of the dispenser tab, the spring 415 causes the dispenser tab to move forward thereby causing the rear face to move off the switch 431, which causes the electric pump to deactivate. As can be appreciated, may other arrangements can be used to activate and deactivate the electric pump.

The body 412 of the top portion 410 of the liquid pump mechanism 400 has a generally oval or circular cross-sectional shape; however, it will be appreciated that the body can have many different shapes and/or sizes. The maximum cross-sectional size of the body is generally selected so that the body properly fits in the recessed pump cavity of the cooler lid and larger than in the pump opening in the recessed pump cavity. Such a design can be used to prevent the top portion from inadvertently falling inside the cooler. However, with respect to the bottom portion and the elongated body, the maximum cross sectional size is generally selected so that the bottom portion and the elongated portion can fit through the pump opening in the recessed pump cavity.

The dispenser head 414 is illustrated as being positioned on the top surface of body 412; however, it will be appreciated that the dispenser head can be positioned on other or additional regions of the body of the top portion. Likewise, dispenser tab 420 is illustrated as being positioned on the dispenser head; however, it will be appreciated that the dispenser tab 420 can be positioned on other or additional regions of the top portion 410. As can further be appreciated, the size and/or shape of the dispenser head and the dispenser tab is non-limiting. The dispenser tab, body of the top portion, and/or the dispenser head can include a safety feature (e.g., tab lock, deactivation switch, dispenser head lock and unlock position, etc.) to prevent inadvertent actuation of the electric pump by a user; however this is not required.

The dispenser head includes a fluid channel 417 that is positioned between and fluidly connected to the dispenser opening 416 and central channel 419. The shape and size of fluid channel 417, dispenser opening 416 and central channel 419 is non-limiting. Fluid channel 417 is generally angled upwardly between the point of connection to the central channel and the fluid channel. The upward angle of the fluid channel can be at a constant slope; however, this is not required. The upward angle is generally at about 1-10°, typically 2-7°, and more typically about 2-5°; however, other angles can be used. As illustrated in FIG. 13, the upward angle of the fluid channel is at a constant slope along the majority or fully length of the fluid channel; however, this is not required. As a result of this design, the elevation of the dispenser opening is greater than the lower point of connection 419A of the fluid channel to the central channel. As such, when the liquid pump mechanism is connected to the cooler lid and the cooler lid is connected to the cooler body, and the bottom of the cooler body is resting on a flat surface, the elevation of the dispenser opening is greater than the lower point of connection of the fluid channel to the central channel, there causing liquid in the fluid channel to flow back to the central channel when the electric pump is deactivated so that little of no liquid drips from the dispenser opening during the deactivation of the electric pump.

As illustrated in FIG. 13, the base 433 of the central channel 419 is connected to upper end 446 of the elongated body 440. An adhesive can be used to secure the elongated body to the central channel; however, this is not required. The inner surface of the base of the central channel can include one or more connection ribs to facilitate in maintaining the connection between the elongated body and the central channel; however, this is not required. As can be appreciated, other or additional arrangements can be used to form a connection between the central channel and the elongated portion. Generally, the connection between the central channel and the elongated body forms a liquid proof seal; however, this is not required.

Figure 11:
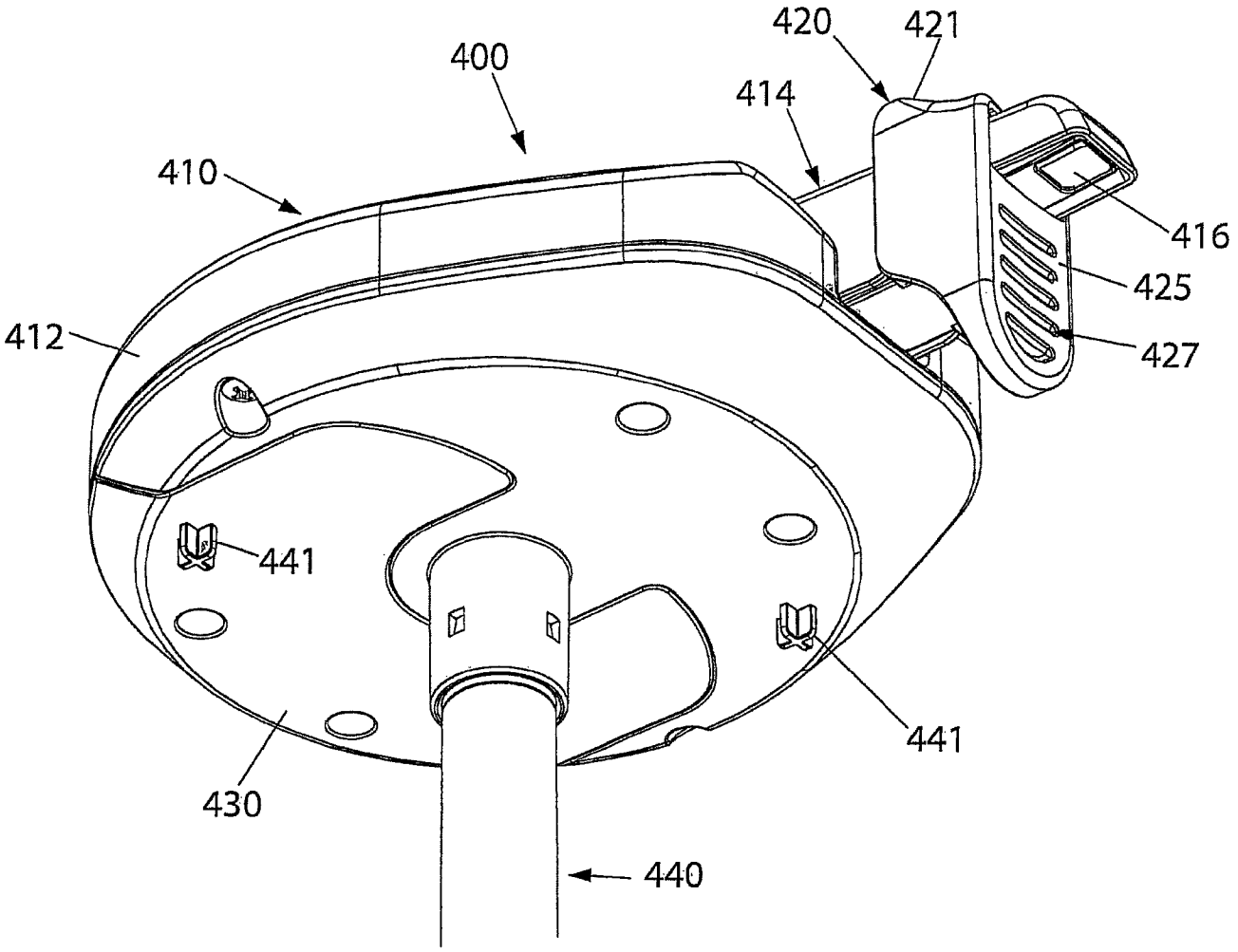
FIG. 11 is a bottom elevation view of the liquid pump mechanism of FIG. 9.
Figure 12:
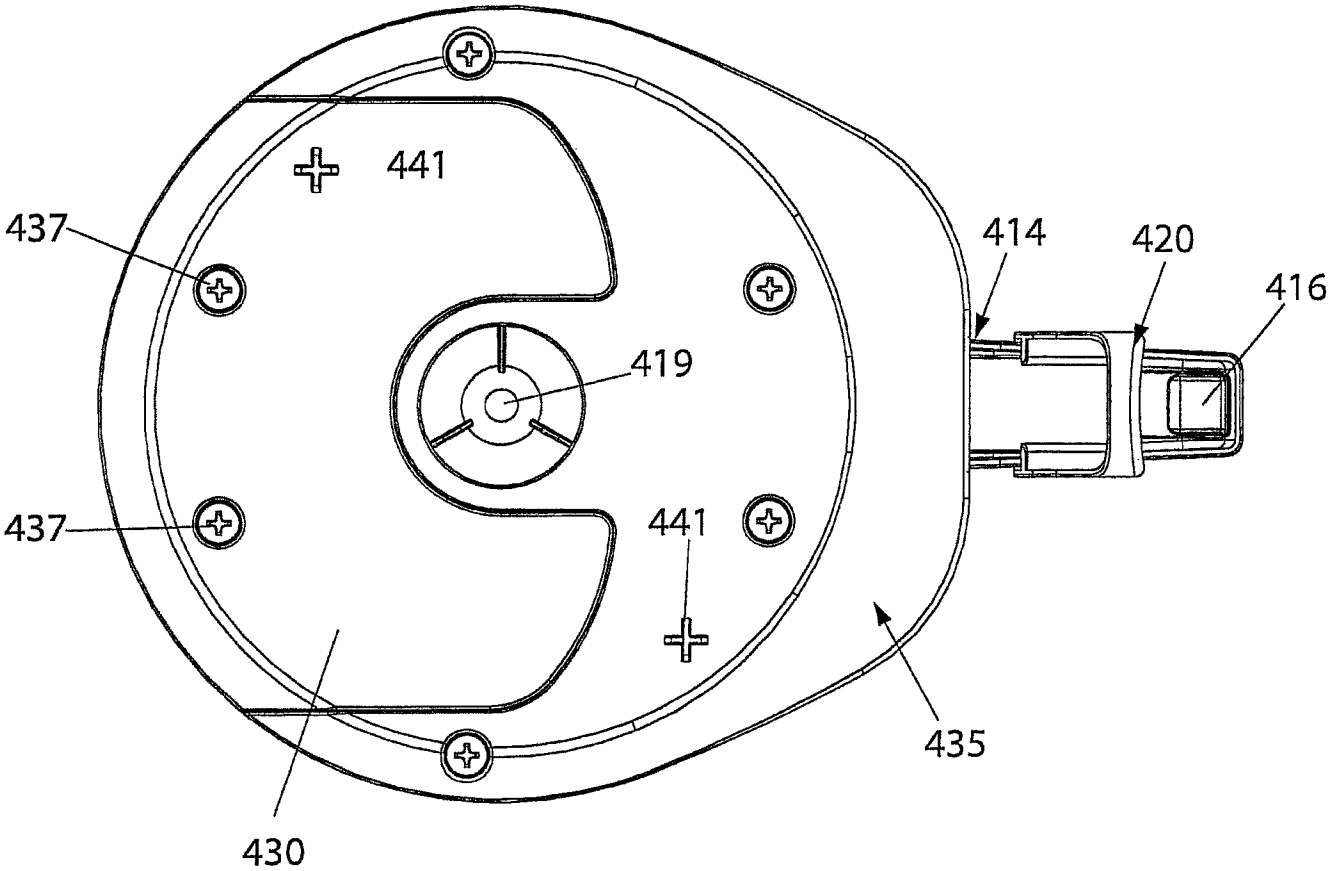
FIG. 12 is a bottom plan view of the liquid pump mechanism of FIG. 9.

As illustrated in FIGS. 11 and 13, the bottom surface 435 of body 412 of the top portion includes a battery cover 430 that is removable to enable a user to access the battery cavity 432 in the body of the top portion. The top portion can include one or more battery cavities. Positionable in the battery cavity is a power supply that is typically in the form of one or more batteries. The power supply is designed to supply electrical power to the electric pump when the dispenser tab is moved rearwardly to the actuation position. As can also be appreciated, the orientation of the one or more batteries in the battery cavity and the top portion is non-limiting. As can also be appreciated, the type of batteries used to power the electric pump is non-limiting. The battery cavities generally include electric connectors that are in turn directly or indirectly connected to wires 500, 502. The battery cover 430 can be connected to the bottom of the top portion by one or more screws 437; however, other or additional connection arrangements can be used.

The top portion 410 of the liquid pump mechanism is designed to be rotatably connected to the cooler lid; however, this is not required. As illustrated in FIG. 13, a connection flange 439 that extends downwardly from the bottom surface 435 that is designed to be inserted into the pump opening 340 in the cooler lid. Generally the cross-sectional shape of the connection flange is circular; however, this is not required. The length, size and shape of the connection flange are non-limiting. Generally, the cross-sectional shape of the connection flange is the same as the cross-section shape of the pump opening. The outer surface of the connection flange and/or the inner surface of the pump opening can include one or more engage arrangements (e.g., ribs, slots, etc.) to facilitate is connecting the connection flange in the pump opening; however, this is not required. Generally, the connection flanges enables the liquid pump mechanism to be connected and disconnected from the cooler lid; however, this is not required. The disconnecting of the liquid pump mechanism from the cooler lid can be used to facilitate in the cleaning of the component of the cooler, enable batteries to be replaced in the liquid pump mechanism, etc. The top portion of the liquid pump mechanism can be designed to be friction/compression fitted, snap fitted, twist fitted, etc. to the cooler lid; however, other or additional connection arrangements can be used.

Figure 3:
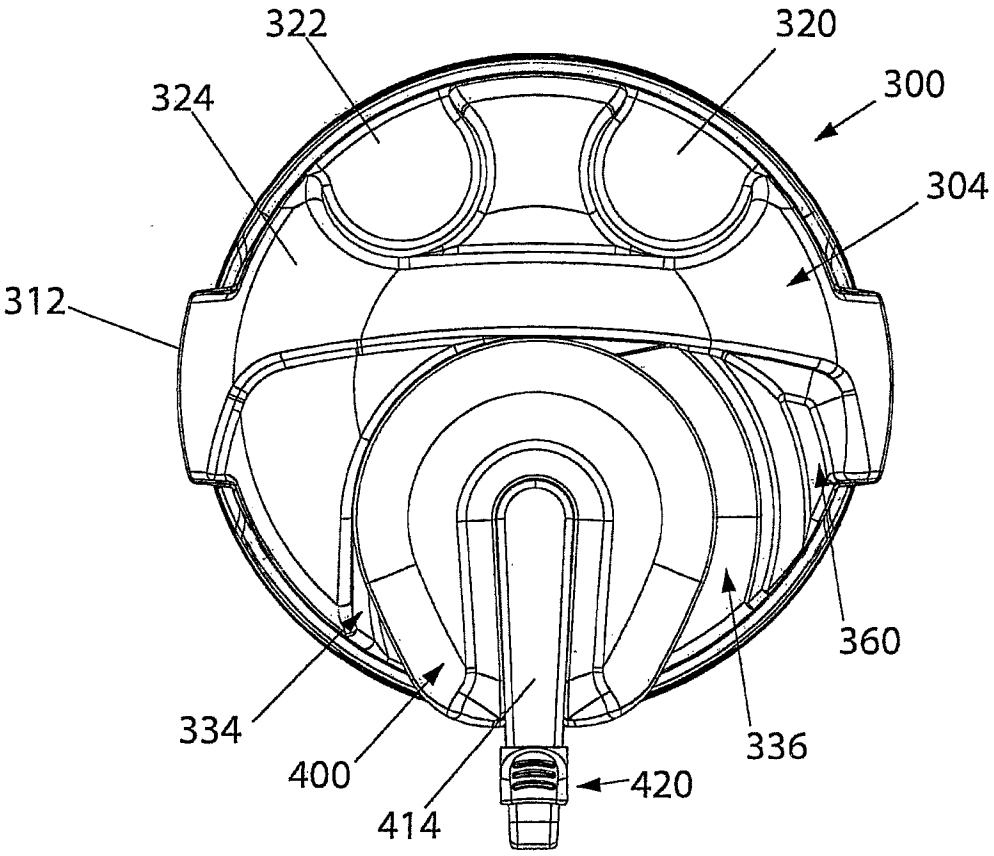
FIG. 3 is a top plan view of the cooler of FIG. 1.
Figure 5:
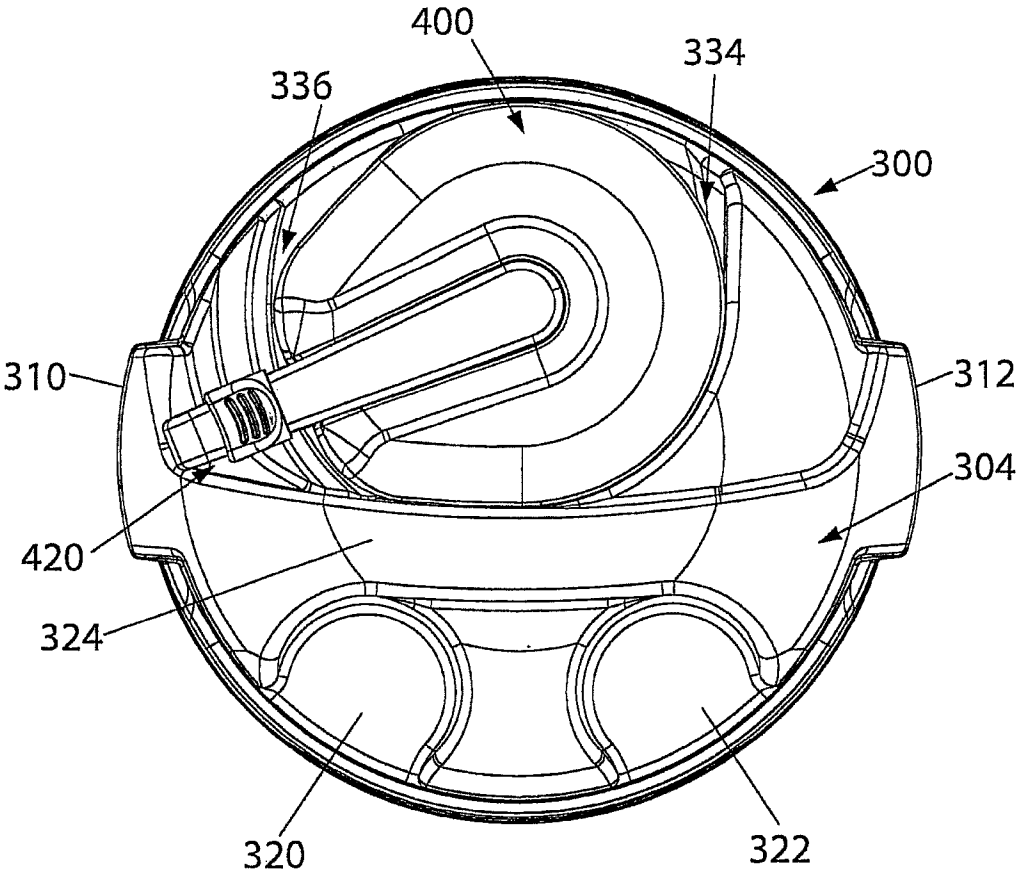
FIG. 5 is a top plan view of the cooler of FIG. 4.

The bottom surface 435 of the top portion can also include one or more positioning tabs 441. As illustrated in FIG. 11, the bottom surface includes two positioning tabs. The positioning tabs are designed to fit into rotational slots 350, 352 on the cooler lid. The position tabs in combination with rotational slots control or limit the amount of rotation of the top portion of the liquid pump mechanism on the cooler lid. As illustrated in FIGS. 1-3, the top portion of the liquid pump mechanism is positioned in the activation or operational position. As mentioned above, in this position, liquid in the cooler body can be dispensed from the dispenser opening on the top portion of the liquid pump mechanism by moving the dispenser tab rearwardly to the activation position. As illustrated by the arrow in FIG. 1, the top portion of the liquid pump mechanism can be rotated counter-clockwise to cause the dispenser tab to move into the dispenser tab cavity 360 as illustrated in FIGS. 4-5. As mentioned above, the design of the dispenser tab cavity enables the dispenser tab to move into the dispenser tab cavity, but also inhibits or prevents the rearward movement of the dispenser tab while in the dispenser tab cavity, thereby inhibiting or preventing activation of the liquid pump mechanism. When the liquid pump mechanism is to be used again, the top portion of the liquid pump mechanism is rotated in the clockwise direction as indicated by the arrow in FIG. 5 until the dispenser tab exits the dispenser tab cavity. During the clockwise and counterclockwise rotation of the top portion of the liquid pump mechanism, the positioning tabs on the top portion and the rotational slots in the cooler lid control and limit the amount to which the top portion of the liquid pump mechanism can rotated in the clockwise and counterclockwise directions. As can be appreciated, the cooler lid and liquid pump mechanism can be designed such that the top portion of the liquid pump mechanism is rotated in the clockwise direction to cause the dispenser tab to move into the dispenser tab cavity.

As can be appreciated, the cooler lid can be designed for use with two or more liquid pump mechanism; however, this is not required. In such an arrangement, the cooler lid would include a plurality of the structures discussed above to enable two or more liquid pump mechanism to be simultaneously used on the cooler as described above with regard to the single liquid pump mechanism.

The cooler of the present invention has the advantage over the standard dispensers on cooler in that 1) the dispensing arrangement of the present invention can dispense liquids in the cooler even when the liquid level in the cooler is low without having to tip the cooler, 2) the dispensing arrangement provides for more convenient dispensing of liquid from the cooler to a user, and/or 3) the dispensing arrangement can reduce damage to the dispenser during the transport and/or storage of the cooler. As can be appreciated, the cooler lid and/or liquid pump mechanism can be offered or sold separately from and standard cooler. In such a situation, the cooler lid to the standard cooler is merely substituted for the cooler lid and/or liquid pump mechanism. As can be appreciated, the cooler lid and liquid pump mechanism of the present invention can be used on other coolers that can be used with a similar sized top portion or lid. As such, the liquid pump mechanism arrangement can be designed to be used with different coolers that can accommodate the lid that includes the liquid pump mechanism.

As mention above, the ability to swivel the top portion of the liquid pump mechanism has the advantage of moving at least a portion of the dispenser head into the interior region of the cooler lid so as to reduce or prevent damage to the dispenser head when the cooler is being transported or not in use. The swiveling of the top portion can also be used to activate/deactivate the liquid pump mechanism; however, this is not required. The swiveling of the top portion can also be used to stop or limit flow of flow through the liquid pump mechanism; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

I claim:

1. A cooler having a fountain type dispenser comprising:

a. a cooler body having a cavity that is configured to contain a liquid, said cavity having a volume of at least one gallon;

b. a cooler lid, said cooler lid including a lid bottom portion that is removably connected to a body top portion of said cooler body, a lid top portion of said cooler lid including a recessed portion and at least one pump opening positioned in said recess portion, said at least one pump opening positioned through a body of said cooler lid, said recess portion forming only a portion of said lid top portion, a rotational limit arrangement that limits a rotation distance said liquid pump mechanism can rotate on said lid top portion of said cooler lid; and, c. a liquid pump mechanism for dispensing liquid from said cavity of said cooler body, said liquid pump mechanism including a pump top portion and a pump bottom portion, an electric pump and a power supply to power said electric pump; said electric pump drawing liquid into said pump bottom portion and to said pump top portion when said electric pump is activated, said pump bottom portion fluidly connected or interconnected to said pump top portion, said pump top portion including a dispenser tab and a dispenser head, said dispenser tab causing activation and deactivation of said electric pump when moved between an activation position and non-activation position respectively, said dispenser head enabling liquid that flows to said pump top portion to exit said pump top portion through a dispenser opening in said dispenser head, said pump bottom portion configured to be inserted through said pump opening in said cooler lid when said pump top portion is connected to said recess portion of said lid top portion of said cooler lid, said pump top portion is rotatable on said lid top portion of said cooler lid.

2. The cooler as defined in claim 1, including an electrical connection between said power supply and said electric pump, said pump bottom portion at least partially includes said electric pump and said pump top portion at least partially includes said power supply, said electrical connection including at least one electric wire.

3. The cooler as defined in claim 2, wherein said pump bottom portion fully contains said electric pump and said pump top portion fully contains said power supply.

4. The cooler as defined in claim 1, wherein said dispenser tab is movable forwardly and rearwardly along a longitudinal axis of said dispenser head, at least a portion of the dispenser tab is positioned below and above said dispenser opening in said dispenser head, said dispenser tab biased in a non-activation position.

5. The cooler as defined in claim 1, wherein said liquid pump mechanism is removably connected to said cooler lid.

6. The cooler as defined in claim 1, wherein said lid top portion of said cooler lid including a recessed portion and at least one pump opening positioned in said recess portion, said at least one pump opening positioned through a body of said cooler lid, said recess portion forming only a portion of said lid top portion, said recess portion of said lid top portion includes a top lid and configured such that a majority of said pump top portion of said liquid pump mechanism is positioned below said top lid of said recess portion.

7. The cooler as defined in claim 1, wherein at least a portion of said rotational limit arrangement is configured such that said pump top portion of said liquid pump mechanism rotates less than 360° when connected to said lid top portion.

8. The cooler as defined in claim 1, wherein said cooler lid includes a dispenser tab cavity, said dispenser tab cavity configured to inhibit movement of said dispenser tab and to maintain said dispenser tab in said non-activation position when said pump top portion is moved in said recess portion of said lid top portion such that said dispenser tab is positioned in said dispenser tab cavity.

9. The cooler as defined in claim 8, wherein said dispenser tab cavity is positioned adjacent to said recess portion of said lid top portion.

10. The cooler as defined in claim 1, wherein said lid top portion of said cooler lid includes at least one structure selected from the group consisting of a handle portion positioned on an outer peripheral region of said cooler lid and a cup cavity.

11. The cooler as defined in claim 1, wherein said dispenser head includes a fluid channel that is angled upwardly at about 1-10°.

12. A method for converting a cooler into a cooler having an electric dispenser comprising:

a. providing a cooler, said cooler having a cooler body and a cooler lid, said cooler body having a cavity that is configured to contain a liquid, said cavity having a volume of at least one gallon, said cooler lid including a lid bottom portion that is removably connected to a body top portion of said cooler body, a lid top portion of said cooler lid including at least one pump opening, said at least one pump opening positioned through a body of said cooler lid;

b. providing a liquid pump mechanism to dispense liquid from said cavity of said cooler body, said liquid pump mechanism including a pump top portion and a pump bottom portion, an electric pump and a power supply to power said electric pump; said electric pump drawing liquid into said pump bottom portion and to said pump top portion when said electric pump is activated, said pump bottom portion fluidly connected or interconnected to said pump top portion, said pump top portion including a dispenser tab and a dispenser head, said dispenser tab causing activation and deactivation of said electric pump when moved between an activation position and non-activation position respectively, said dispenser head enabling liquid that flows to said pump top portion to exit said pump top portion through a dispenser opening in said dispenser head, said pump top portion is rotatable on said lid top portion of said cooler lid, said lid top portion of said cooler lid includes a rotational limit arrangement that limits a rotation distance said pump top portion can rotate on said lid top portion, said liquid pump mechanism is removably connected to said lid top portion; and, c. connecting said liquid pump mechanism to said cooler lid by inserting said pump bottom portion through said pump opening in said cooler lid, then connecting said pump top portion to said lid top portion, and then connecting said lid top portion to said cooler lid, said pump top portion moveable relative to said lid top portion.

13. The method as defined in claim 12, wherein said rotational limit arrangement includes at least one rotational slot in said recess portion of said lid top portion, said pump top portion of said liquid pump mechanism including at least one positioning tab that is configured to engage said at least one rotational slot when said liquid pump mechanism is connected to said recess portion of said lip top portion of said cooler lid, at least a portion of said rotational limit arrangement is configured such that said pump top portion of said liquid pump mechanism rotates less than 360° when connected in said recess portion of said lid top portion.

14. The method as defined in claim 13, wherein said recess portion of said lid top portion includes a top lid and the recess portion is configured such that a majority of said pump top portion of said liquid pump mechanism is positioned below said top lid of said recess portion.

15. The method as defined in claim 13, wherein said cooler lid includes a dispenser tab cavity, said dispenser tab cavity configured to inhibit movement of said dispenser tab and to maintain said dispenser tab in said non-activation position when said pump top portion is moved in said recess portion of said lid top portion such that said dispenser tab is positioned in said dispenser tab cavity, said dispenser tab cavity is positioned adjacent to said recess portion of said lid top portion.

16. The method as defined in claim 12, wherein said lid top portion of said cooler lid includes at least one structure selected from the group consisting of a handle portion positioned on an outer peripheral region of said cooler lid and a cup cavity.

17. The method as defined in claim 12, wherein said pump bottom portion fully contains said electric pump and said pump top portion fully contains a power supply, an electrical connection that is used to provide current to said electric pump that is located between said pump top portion and said pump bottom portion is fully positioned inside an elongated body that is positioned between and fluidly connected to said pump top and bottom portions, said electrical connection isolated from fluid flowing through said elongated body as fluid flows from said pump bottom portion through said elongated body portion and to said pump top portion.

18. The method as defined in claim 12, wherein said pump bottom portion includes a bottom opening and a plurality of base ribs extending downwardly from a bottom surface of said pump bottom portion, said base ribs preventing sealing of said bottom opening with a bottom surface of said cavity of said cooler when said pump bottom portion is placed in said cavity of said cooler.

19. The method as defined in claim 12, wherein said dispenser head includes a fluid channel that is angled upwardly at about 1-10°.

* * * * *